United States Patent [19]

Gläser et al.

[11] Patent Number: 4,838,980

[45] Date of Patent: Jun. 13, 1989

[54] METHOD AND APPARATUS FOR INTRODUCING AND JOINING DIAPHRAGMS IN SLOTTED WALLS

[75] Inventors: Eberhard Gläser, Aichwald; Eberhard Beitinger, Stuttgart; Manfred Nussbaumer, Leonberg, all of Fed. Rep. of Germany

[73] Assignee: Ed. Züblin Aktiengesellschaft, Stuttgart-Möhringen, Fed. Rep. of Germany

[21] Appl. No.: 37,082

[22] Filed: Apr. 10, 1987

Related U.S. Application Data

[62] Division of Ser. No. 768,458, Aug. 22, 1985, abandoned.

[30] Foreign Application Priority Data

| | | | |
|---|---|---|---|
| Aug. 22, 1984 | [DE] | Fed. Rep. of Germany | 3430789 |
| Jun. 11, 1985 | [DE] | Fed. Rep. of Germany | 3520820 |
| Jun. 11, 1985 | [DE] | Fed. Rep. of Germany | 3520817 |

[51] Int. Cl.[4] ..... B29C 47/12

[52] U.S. Cl. ..... 156/497; 156/498; 156/499; 156/500; 425/113; 425/202; 425/460; 425/379.1

[58] Field of Search ..... 156/497, 498, 499, 500, 156/304.2, 304.3, 304.6, 244.11, 244.23, 244.24; 425/113, 122, 127, 202, 203, 204, 205, 376 B, 378 R, 379 R, 381.2, 460, 500, 505

[56] References Cited

U.S. PATENT DOCUMENTS

| | | | |
|---|---|---|---|
| 3,310,952 | 3/1967 | Veder | 405/267 |
| 3,550,815 | 12/1970 | Salonen | 425/378 R |
| 3,658,627 | 4/1972 | Kaminsky | 156/497 |
| 3,759,044 | 9/1973 | Caron et al. | 405/267 |
| 3,820,344 | 6/1974 | Caron et al. | 405/267 |
| 3,839,126 | 10/1974 | Haller | 156/497 |
| 4,193,716 | 3/1980 | Piccagli | 405/267 |
| 4,319,871 | 3/1982 | McAlister | 425/378 R |
| 4,519,729 | 5/1985 | Clarke | 405/258 |
| 4,601,615 | 7/1986 | Cavalli | 405/267 |

FOREIGN PATENT DOCUMENTS

| | | | |
|---|---|---|---|
| 209010 | 4/1984 | Fed. Rep. of Germany | 405/270 |
| 49424 | 4/1980 | Japan | 405/267 |
| 104715 | 6/1982 | Japan | 405/267 |
| 8300596 | 9/1984 | Netherlands | 405/281 |
| 619175 | 9/1980 | Switzerland | 156/497 |
| 643359 | 1/1979 | U.S.S.R. | 156/497 |

*Primary Examiner*—Caleb Weston

*Attorney, Agent, or Firm*—Becker & Becker, Inc.

[57] ABSTRACT

A method and apparatus of introducing and joining diaphragms in slotted walls. The slotted inner connecting pipe of one diaphragm is introduced into the slotted outer connecting pipe of another diaphragm. An apparatus for fusing together the two connecting pipes is placed within the interior of the inner pipe and can move through the latter. The apparatus has a heating device for heating and fusing the two connecting pipes together.

11 Claims, 18 Drawing Sheets

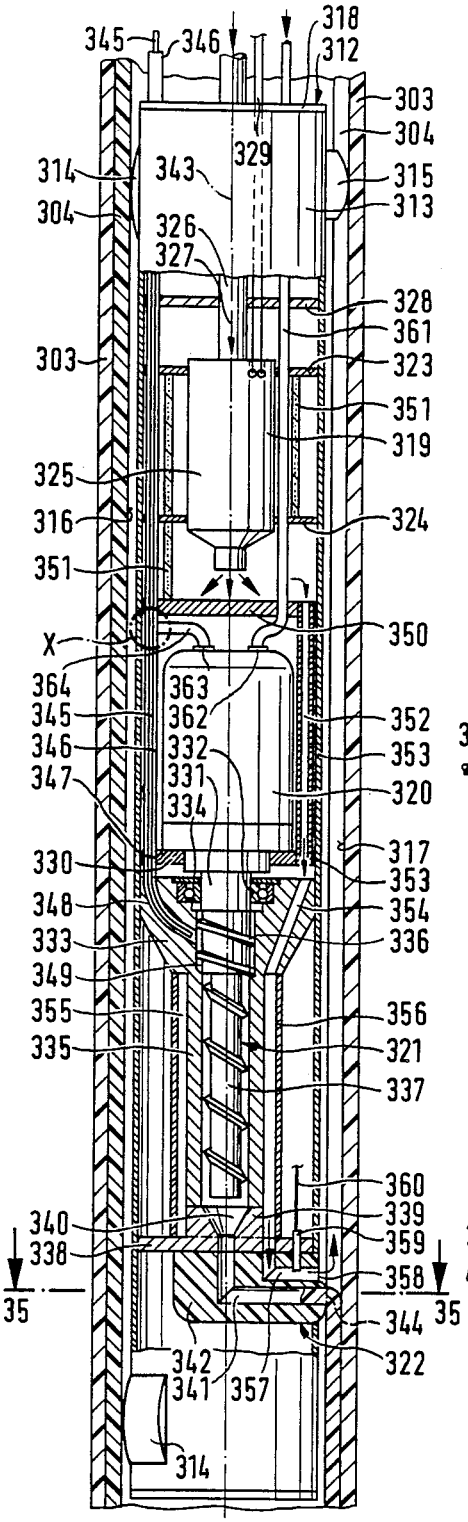
Fig. 33
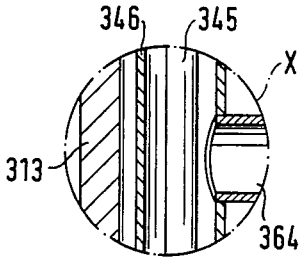
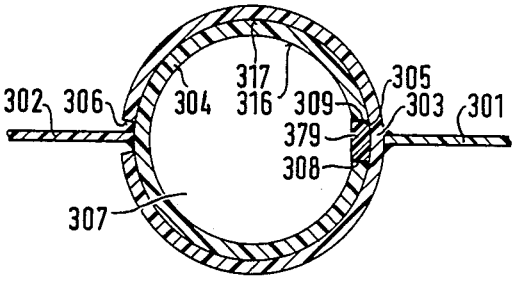
Fig. 34
Fig. 35
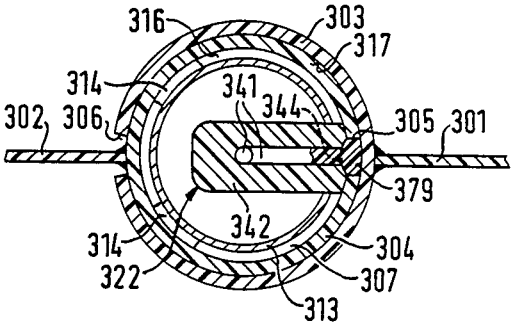

METHOD AND APPARATUS FOR INTRODUCING AND JOINING DIAPHRAGMS IN SLOTTED WALLS

This is a division of co-pending parent application Ser. No. 768,458-Gläser et al filed Aug. 22, 1985, now abandoned.

BACKGROUND OF THE INVENTION 1. field of the invention

The present invention relates to a method and apparatus for joining diaphragms in slotted walls which are produced in a known manner in a single or dual phase system; the method includes the steps of introducing diaphragm sections as additional protection against seepage, and continuously interconnecting the vertical edges of the diaphragm sections.

2. Description of the prior art

Slotted walls are generally installed as vertical sealing measures in the ground to seal against ground water and seepage water in foundation and water construction, and for the sealing of dumps and the like. The manufacture of slotted walls, which can be installed to depths of 30 m and greater, is effected from the surface of the ground by cutting, washing, and excavating vertical, slot-like hollow spaces which are secured against collapse by a fluid-suspension filling having thixotropic properties. In the so-called single phase system, a material such as cement and/or other binders is added to the support fluid to make it possible for the latter to remain as the slotted-wall mass. In the dual phase system, the support fluid is displaced and replaced by the final slotted-wall mass, such as concrete, by filling the remaining mass from below toward the top. Depending upon the geological conditions and the projected depth, the slotted walls can be continuously constructed in a known manner slot for slot, or a pilgrim step method, with primary and secondary sheets.

To increase the water tightness of the slotted walls, dense diaphragms and/or multi-layered diaphragms are additionally installed in the slot. The multi-layered diaphragms comprise at least one permeable and one dense layer, with the permeable layer acting as a "hydraulic trap" for seepage water and diffusing media, with fluid which has penetrated being withdrawn. Various solutions have been proposed for introducing such diaphragms into a slotted wall, and for interconnecting the diaphragms.

Published European Patent Application No. 0 074 686 discloses a method for installing flexible sealing diaphragms and for connecting the thin sheets by overlapping the layers or by injecting material which hardens into the region of the vertical sheet connections German Offenlegungsschrift No. 25 46 946 discloses a method for introducing an elastic sealing diaphragm using the pilgrim step method, with the connections of the ends of the sheet again having to be rinsed free for manufacture, whereby the hollow space of the slotted wall is temporarily not secure during the time the connection is made.

German Offenlegungschrift No. 23 45 983 discloses introducing a thin sheet from a vertical container which be moved through the support fluid in the trench; the application of this method must for technical reasons must be limited to very shallow slots.

The further published European Patent Application No. 00 86 001 amplifies the solution of the first mentioned patent for combining the ends of very thin sheets.

Unfortunately, none of the aforementioned proposals takes into account the problem of manufacturing deep slotted walls having depths of greater than 5 m. If a thin slotted wall sheet is produced, the thin sheets must be produced with sufficient overlapping lengths, and during excavation of the next sheet must be protected from damage by the loosening, cutting, or excavating, after placement of the diaphragm in the adjacent slotted wall, the two diaphragms should be able to be permanently connected by welding, gluing, or other types of connection.

It is therefore an object of the present invention for the sealing of slotted walls by the additional installation of diaphragms, to provide a method for the satisfactory introduction into slotted walls of the diaphragms, and for permanently and reliably connecting the diaphragms. It is a further object of the present invention to provide an apparatus for carrying out such a method.

BRIEF DESCRIPTION OF THE DRAWINGS

These objects, and other objects and advantages of the present invention, will appear more clearly from the following specification in conjunction with the accompanying drawings, in which:

FIG. 10 is a schematic cross-sectional view through the connecting pipes and a device for fusing the latter together;

FIG. 33 is a view that shows a longitudinal section through a further embodiment of the inventive device, which is disposed in connecting pipes which are to be fused to one another;

FIG. 34 is a cross-sectional view showing two connecting pipes which have been fused with one another using the device of FIG. 33;

FIG. 35 is a view that shows a section taken along the line 35—35 in FIG. 33;

SUMMARY OF THE INVENTION

Figure 1:
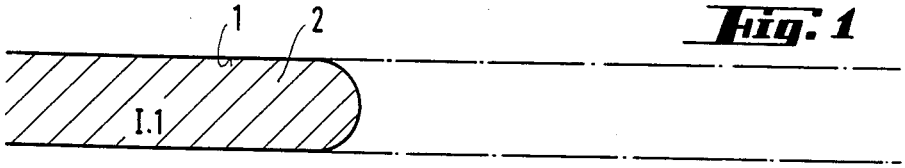
FIGS. 1–8 are schematic plan views showing the phases of the production of the slotted wall and of the connection of the diaphragms.
Figure 2:
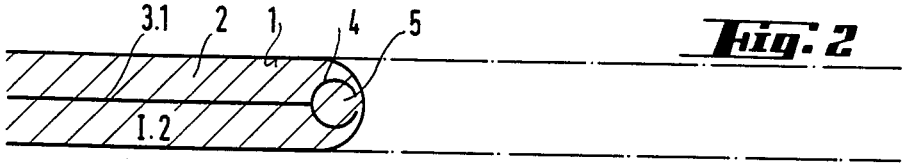
Figure 3:
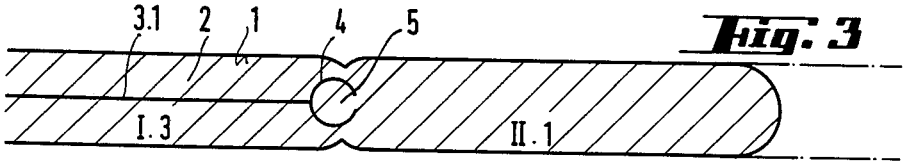
Figure 4:
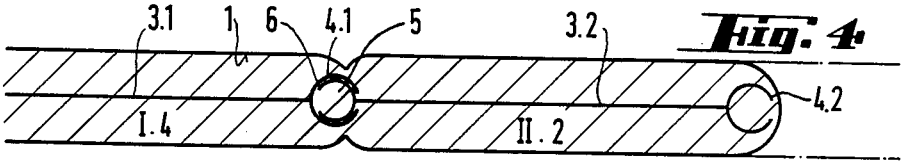

The method of the present invention is characterized primarily by the following steps: producing a first slotted-wall section by excavation, cutting, or flushing; bracing the boundaries of the hollow space of the first slotted-wall section by introducing therein a support fluid; introducing a first diaphragm section over the entire depth of the slotted-wall section; providing on that one of the vertical edges of the diaphragm section which faces in the direction in which production of the slotted wall is proceeding a first connecting pipe which is outwardly slotted or perforated; producing along the first connecting pipe an adjacent second slotted-wall section, with said producing taking place no sooner than said step of introducing said first diaphragm section; when the support fluid of the first slotted-wall section begins to harden, rinsing-free the interior of the first connecting pipe, for example with high-pressure water streams; providing a second diaphragm section; providing the second diaphragm section with a first connecting pipe in the same manner in which said first diaphragm section was provided with a first connecting pipe; providing the second diaphragm section with a second slotted connecting pipe on that one of the vertical edges of the diaphragm section opposite the first connecting pipe, with the outer diameter of the second connecting pipe being less than the inner diameter of the first connecting pipe; introducing the second diaphragm section into the second slotted-wall section by introducing the second connecting pipe into the first connecting pipe of the first diaphragm section; when the support fluid of the second slotted-wall section begins to harden, rinsing-free the interior of the first connecting pipe of the first diaphragm section, for example with a high-pressure water stream, and emptying said interior; connecting the facing contact surfaces of the first and second connecting pipes; and repeating the previous steps until a slotted wall of required length is produced.

Slotted connecting pipes are permanently and sealingly attached to the vertical edges of the diaphragm sections, which have a width which is somewhat greater than that of the slotted-wall section. In each case, an inner connecting pipe of the adjacent diaphragm section is introduced into an outer connecting pipe of a given diaphragm section during the introduction of the diaphragm into the slotted-wall section. The outer diameter of the outer connecting pipe is less than the thickness of the slotted wall. The outer diameter of the inner connecting pipe is less than the inner diameter of the outer connecting pipe. The inner diameter of the inner connecting pipe is such that suitable devices for cleaning and joining the contact pipes at their contact surfaces can be introduced and moved vertically in the interior of the connecting pipe. In contrast to the heretofore known methods, the particularly advantageous aspect of the inventive method and apparatus is that they can be used for all methods of manufacturing the slotted wall, and for all slotted-wall geometries. With the present invention, it is furthermore possible to tightly join the diaphragm sections in a controlled manner by gluing, welding, and other joining methods under defined conditions. The inventive method is suitable for manufacturing the slotted wall in both single and dual phase systems with the replacement of the support fluid by a suitable and remaining slotted-wall mass.

The device of the present invention may be characterized by a joining unit having a frame on which are mounted pressure rollers which engage against the inner wall of the inner connecting pipe, and by a device connected to the joining unit for introducing heat, glue, or extruder material. The inventive device may also be characterized by: a profiled fusing piece which is disposed between the inner connecting pipe and the outer connecting pipe and has a part which projects inwardly through the slot of the inner connecting pipe; a heating device for heating the profiled piece and the inner and outer connecting pipes which ar to be fused together; at least one pressure mechanism which follows the heating device in the direction of movement of the inventive device through the interior of the inner connecting pipe, with said pressure mechanism being adapted to be shifted between an operating position and a rest position; and at least one deforming member which follows the heating device in the direction of movement of the inventive device for bending the projecting part of the profiled piece outwardly against the outer connecting pipe during movement of the inventive device.

With the inventive apparatus, that part of the profiled fusing piece which projects into the longitudinal slot of the inner connecting pipe can be reliably pressed against the outer connecting pipe by the deforming member.

The projecting part of the profiled piece is first heated by the heating device to the temperature necessary for fusing. As the apparatus moves through the interior of the inner connecting pipe, the following deforming member then presses this heated, projecting part of the profiled piece outwardly against the outer connecting pipe. The following pressure mechanism presses the outwardly bent part of the profiled piece firmly against the outer connecting pipe to produce a tight connection. In order that when the apparatus is introduced into the connecting pipes the deforming member does not come into contact with the projecting part of the profiled piece, it is shifted from the operating position into a rest position. This assures that the profiled piece is not damaged during lowering of the apparatus into the connecting pipes.

Pursuant to another inventive embodiment, the apparatus may be characterized by: an extruder for extruding fusable material; at least one guide means which extends to and opens into the extruder, and in which a welding rod can be moved to the extruder; a size-reducing part connected to the extruder, in the vicinity of where the guide means open into the latter, for reducing the size of the welding rod; a heating device connected downstream of the size-reducing part for melting the size-reduced pieces of the welding rod; and at least one welding shoe which is connected to the extruder and has at least one outlet opening directed at the location which is to be fused.

With such an apparatus, the welding rod is supplied via the guide means to the size-reducing part, with which the welding rod can be continuously reduced in size. In the subsequently connected heating device, the size-reduced pieces of the welding rod are melted, so that melted welding material exits the outlet opening of the welding shoe. This material exits in the fusing region, so that when the inventive apparatus is pulled up, the two connecting pipes are continuously sealingly fused with one another. Since the weldable material is in the form of a welding rod, it can be pushed in the guide means without difficulty from the region beyond the connecting pipes to the extruder, so that the welding material can be continuously supplied.

Further features of the present invention will be described subsequently.

DESCRIPTION OF PREFERRED EMBODIMENTS

Referring now to the drawings in detail, FIGS. 1–8 schematically illustrate the phase-like sequence of the slotted- wall manufacture and the diaphragm ceiling. With regard to the Roman numeral/Arabic numeral combinations, the Roman numerals in each case refer to the slotted-Wall section, and the Arabic numerals refer to the manufacturing phase. With the aid of a slotted-wall grabber, a milling machine, or hydraulic units, a slotted-wall section I is dug out to the required depth in the direction of the projected orientation of the slotted wall. Within the boundary 1 of the slotted wall, the slot is filled with a suspension 2 which initially fulfills the function of a support fluid so that the slot does not collapse due to ground pressure and the entry of water. With a single phase system, a hardening agent, such as cement, sodium silicate, hardeners, and the like, are added to this support fluid, so that after hardening the suspension 2 also fulfills the function of the final slotted-wall mass.

When the slotted-wall section is dug out to the projected depth, a diaphragm section 3 1 is introduced into the slotted wall. The length of the diaphragm section 3 1 corresponds to the depth of the slotted wall section An outer connecting pipe 4 is permanently and sealingly connected to the vertical edge of the diaphragm section 3.1 in the advancing direction of the slotted wall. An inner connecting pipe 6 is permanently and sealingly connected to the opposite vertical edge of the diaphragm 3.1. The width of the diaphragm section 3.1 is at least as great as the width of the slotted-wall section, or is even greater. The interior 5 of the outer connecting pipe 4 is also filled with the suspension 2 during the process of positioning the diaphragm section 3.1 in the slot I.

As the manufacture of the slotted wall continues, the next slotted-wall section II is produced along the outer connecting pipe 4.

In the phase I.4 and II.2 of the inventive method, a diaphragm section 3.2 is introduced into the slotted-wall section II. In so doing, the inner connecting pipe 6 of the diaphragm section 3.2 is introduced into the outer connecting pipe 4 of the diaphragm section 3.1. With a single phase system, the suspension 2 is regulated in such a way that the suspension in the interior 5 of the outer connecting pipe 4 has not yet hardened. A variation of this method, where the interior 5 is protected against the entry of suspension 2 therein by the introduction of a filled diaphragm, will be described subsequently in connection with FIG. 11.

Figure 5:
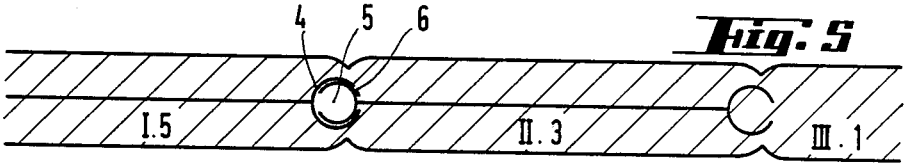
Figure 6:
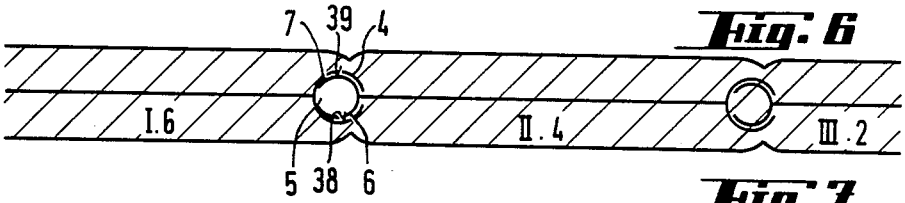
Figure 7:
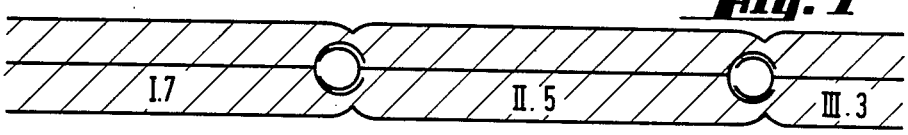
Figure 8:
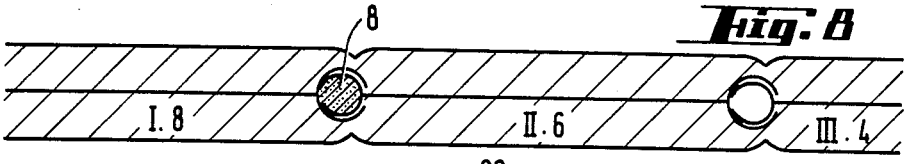

FIG. 5 illustrates the rinsing-free and emptying of the interior 5. This rinsing-free of the interior is advantageously effected by spraying with a high-pressure stream which is introduced into the interior 5 of the connecting pipes 4 and 6 by means of a nozzle and a nozzle lance. Emptying of the interior 5 is effected by introducing a pump and by withdrawing the rinsing fluid. The manufacture of the third slotted-wall section III can take place at the same time as the interior 5 is rinsed-free (phase III.1).

In phase I.6, the cleaning and joining of the connecting pipes is effected by having a suitable device move vertically in the interior 5; examples of such devices will be described subsequently. The result of this method step I.6 is a permanent and sealing bonding or joining 7 of the connecting pipes 4 and 6 to one another. In this way, a continuous joining of the diaphragm sections to one another is produced.

The sealing of the Joint 7 is monitored in the phase I.7. For this purpose, a non-illustrated composition is sealingly and tightly applied to the connecting pipes 4 and 6, and compressed air or pressure fluid is applied to the interior 5; by measuring the pressure over a fixed period of time, the sealing of the joint 7 is determined.

In the final phase I.8, after successful testing of the sealing, the interior 5 is filled with the final slotted-wall mass, or with another suitable mass on a mineral base or of synthetic material. The filler body 8 prevents penetration by undesired materials, and serves as a plug or seal for the permanent safeguarding of the joint.

With the use of the dual phase system for producing the slotted wall, replacement of the purely support fluid by the final and remaining slotted-wall mass can be begun at the earliest in phase I.2. In the dual phase system, the interior 5 is advantageously safeguarded with a built-in, filled, hose-like diaphragm.

A further advantageous possibility for replacing the support fluid with the remaining slotted-wall mass is provided in conjunction with phase I.6, when no suspension can any longer pass into the interior 5 of the connecting pipes 4 and 6. This variation of the method offers the additional advantage that the support fluid 2 in the interior 5 of the connecting pipes 4 and 6 does not harden until the connecting pipe 6 is introduced into the connecting pipe 4 and the pipes are interconnected.

Figure 9:
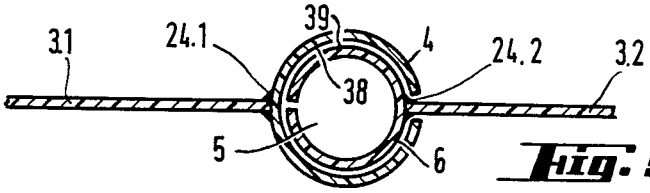
FIG. 9 is a schematic cross-sectional view through the connecting pipes.
Figure 4B:
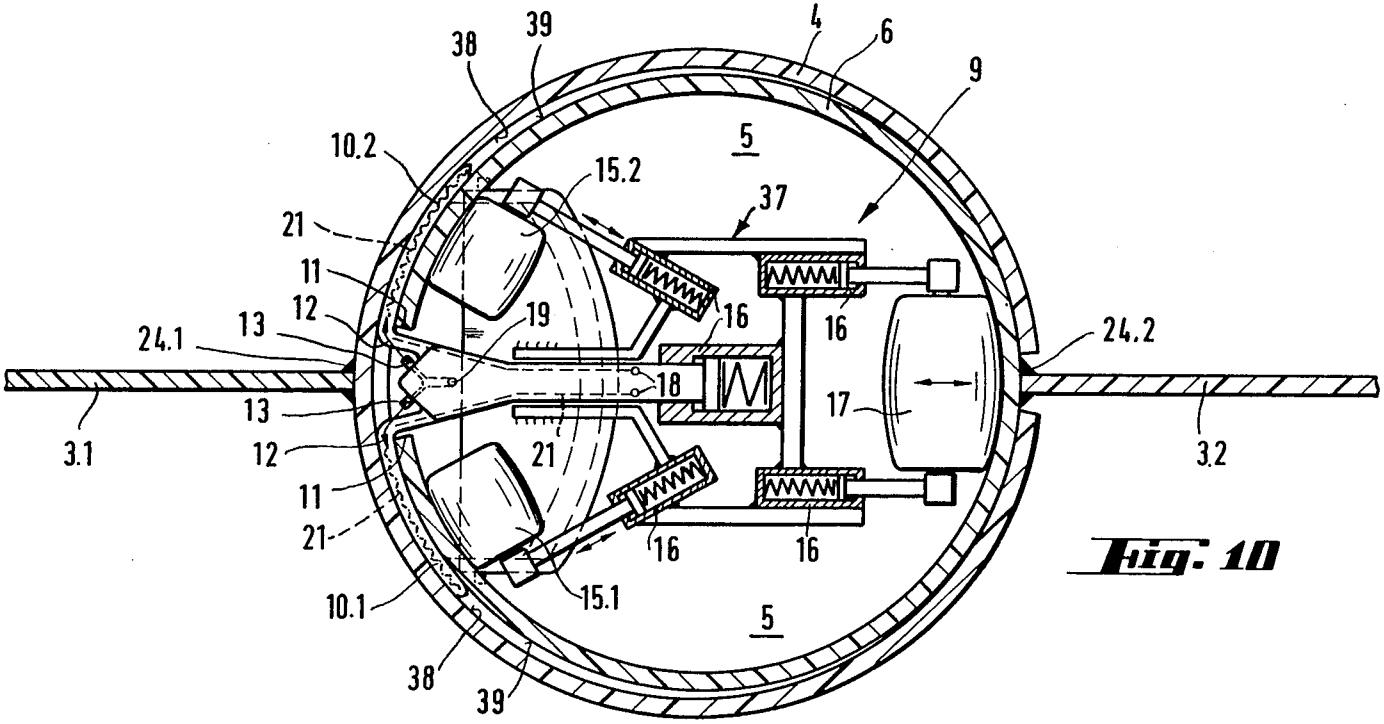

FIG. 9 shows an exemplary embodiment of the connecting pipes 4 and 6. The outer connecting pipe 4 is permantly and sealingly connected with the diaphragm section 3.1 by means of a continuous connection seam 24.1. In a preferred embodiment, the diaphragm 3.1 and the connecting pipes 4 and 6 comprise a fluid-impermeable synthetic material, such as polyvinyl chloride, polypropylene, or polyethylene having a low and high density. The diaphragm can also be made of thermoplastic elastomers on a base of natural or synthetic rubber, which generally have a greater resistance to diffusion. With such an embodiment, the diaphragm 3.1 is advantageously heat-sealed with the connecting pipe 4, so that the connection seam 24.1 is a continuous seam of synthetic material. In addition to being formed by hot V-fusing, hot-air fusing, or extrusion, the Joint can also be effected by gluing or solution fusing. Pursuant to a further advantageous embodiment, the connecting pipes 4 and 6 can be made of metal, preferably a stainless steel that can be welded and which is additionally covered with a corrosion-protecting layer on a base of synthetic material.

The outer diameter of the inner connecting pipe 6 is less than the inner diameter of the outer connecting pipe 4, so that the inner connecting pipe 6 can be introduced into the outer connecting pipe 4. The inner connecting pipe 6 is connected with the diaphragm section 3.2 by a continuous connection seam 24.2. At the contact surfaces 38 and 39, the outer and inner connecting pipes 4 and 6 are connected with one another. Each of the connecting pipes 4 and 6 is provided with a vertical slot, with the width of the slot of the outer connecting pipe 4 being greater than the thickness of the diaphragm 3.2; alternatively, the slot can be disposed about the diaphragm 3.2 with a suitable apparatus which during the introduction elastically spreads the edges of the slot apart to such an extent that the diaphragm 3.2 can pass therethrough. After the diaphragm 3.2 has been introduced, the vertical edges of the slot of the outer connecting pipe 4 rest tightly against the diaphragm 3.2.

FIG. 10 shows one exemplary device for fusing the two connecting pipes 4 and 6 together. The fusing device 9 is disposed in the interior of the inner connecting pipe 6, and is moved vertically in the interior 5 from the bottom toward the top over the entire length of the connection. This exemplary embodiment essentially comprises a frame 37 for carrying the spring legs 16 to which the spindles of the driving and other wheels 15.1, 15.2, and 17 are attached, and for mounting two wedge-shaped heating plates 10.1 and 10.2 which extend between the contact surfaces 38 and 39 of the connecting pipes 4 and 6. The heating plates 10.1 and 10.2 are electrically heated via wires 21, and are connected via connections 18 with a cable which leads to the power source. The heating plates 10.1 and 10.2 are mounted on the frame 37 of the fusing device between the edges 11 of the inner connecting pipes 6. In the illustrated exemplary embodiment of the fusing device, the device for cleaning the contact surfaces 38 and 39 is integrated with the fusing device. A water and/or air stream 12 is introduced through nozzles 13 into the region of the contact surfaces 38 and 39. The water and/or air, which is advantageously heated, is supplied via a supply line 19 from a supply source disposed outside the interior 5 of the connecting pipe 4. Schematically illustrated by dashed lines in FIG. 10 are the pressure rollers for pressing the contact surfaces 38 and 39 together after the heating plates 10.1 and 10.2 have passed them; these heating plates are mounted on the frame 37 below the wheels 15.1 and 15.2.

Not illustrated are further devices for gluing, hot-air fusing, extrusion fusing, or solution fusing; these devices can be mounted on the frame 37 along with support wheels. Exemplary embodiments of such devices will be described subsequently.

Pursuant to one advantageous embodiment, the device for cleaning the contact surfaces can also be guided up and down through the interior 5 of the connecting pipes 4 and 6 as a separate unit, and need not, as previously described, be mounted directly on the fusing device.

Figure 11:
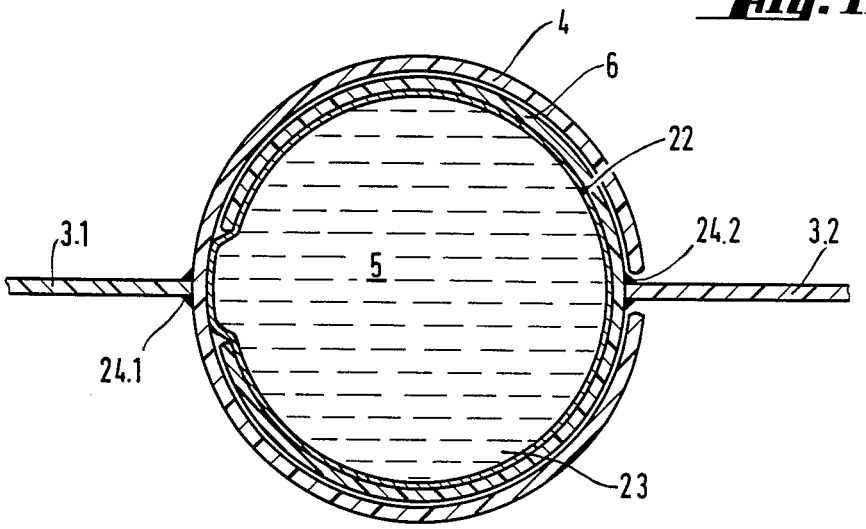
FIG. 11 is a schematic cross-sectional view through the connecting pipes and a filled diaphragm in the interior of the connecting pipes.

FIG. 11 is a schematic sectional view through the connecting pipes 4 and 6; in the interior 5 of the connecting pipes 4 and 6, a hose-like membrane 22 is braced against the inner boundaries of the connecting pipes via a fluid filling 23, thus preventing the penetration of suspension into the interior 5. A further, non-illustrated application of the hose-like membrane 22 comprises the inventive introduction of this fluid-supported seal into the interior of the outer connecting pipe 4 until such a time as the inner connecting pipe 6 is introduced. For this purpose, the hose-like membrane is either withdrawn or relieved to such an extent that the inner connecting pipe 6 can be introduced into the outer connecting pipe 4.

Figure 12:
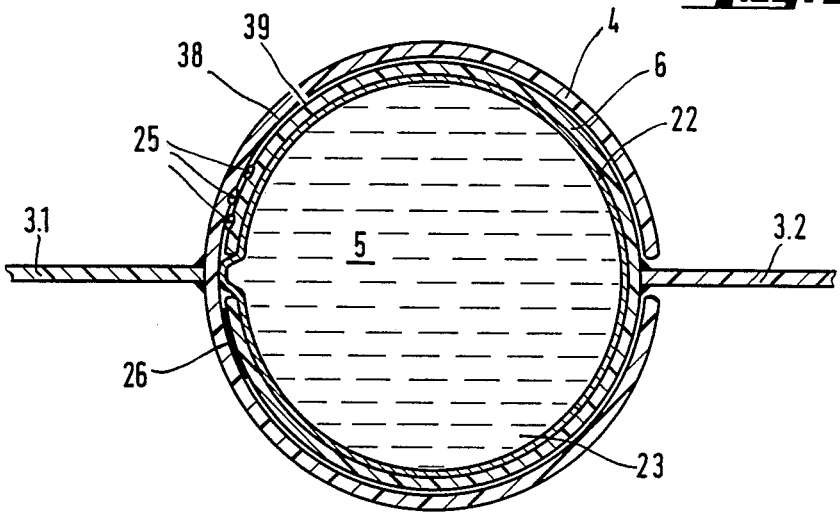
FIG. 12 is a schematic cross-sectional view through the connecting pipes and a connection.

FIG. 12 shows a further possibility for interconnecting the pipes 4 and 6. By means of a hose-like membrane 22 in the interior 5 of the connecting pipe 4 and 6, the inner connecting pipe 6, at the contact surfaces 38 and 39, is pressed against the outer connecting pipe 4 with the aid of compressed air or a pressure fluid in the hose-like membrane 22. Known glow filaments 25 can be incorporated in the surface of at least one of the connecting pipes 4 and 6 in the region of the contact surfaces 38 and 39. By means of a controlled burning of the surrounding region of the synthetic material mass, these filaments plasticize and thus effect a regional fusing (at 26) of the connecting pipes 4 and 6 at the contact surfaces 38 and 39.

Figure 13:
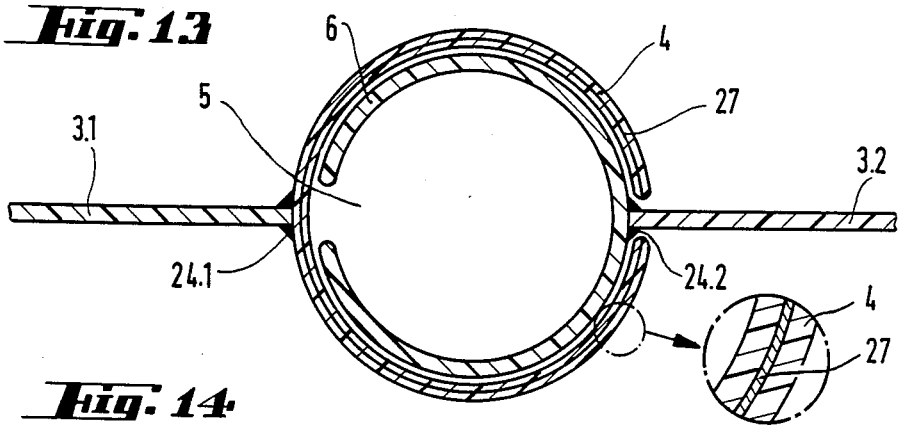
FIG. 13 is a schematic cross-sectional view through the connecting pipes, in which reinforcing rings have been installed.

FIG. 13 illustrates an exemplary variation of the embodiment of the outer connecting pipe 4; in principle, this variation can also be utilized for the inner connecting pipe 6. The outer connecting pipe 4 of synthetic material is reinforced with a thin cylindrical shell 27, preferably of steel. The steel of the cylindrical shell or sleeve 27 is preferably highly elastic spring steel The cylindrical sleeve 27 is completely embodied in the synthetic material of the outer connecting pipe 4, so that no corrosion problems can occur.

Figure 14:
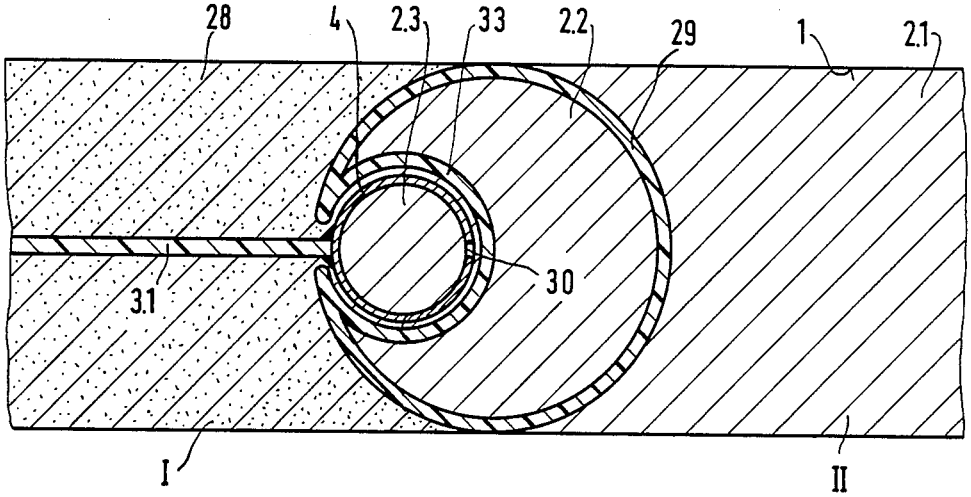
FIG. 14 is a schematic cross-sectional view through the connecting pipes in which an additional pipe has been installed.

FIG. 14 shows an exemplary method of proceeding during the installation of the slotted wall in a dual phase system. For this purpose, a pipe 29 having a ring-shaped recessed portion 23 for receiving the outer connecting pipe 4 is placed between two adjacent slotted-wall sections I and II. The interior of the outer connecting pipe 4, as well as the interior of the pipe 29, are filled with non-hardening support fluid 2.3 and 2.2. In the slotted-wall section I, the support fluid 2 has already been replaced by the remaining and hardening slotted-wall mass 28. After the remaining slotted-wall mass 28 has begun to harden, the pipe 29 is removed, and the diaphragm 3.2 with the inner connecting pipe 6 is placed in the outer connecting pipe 4. The production of the diaphragm connection then proceeds in the manner explained in connection with FIGS. 5–8.

Figure 15:
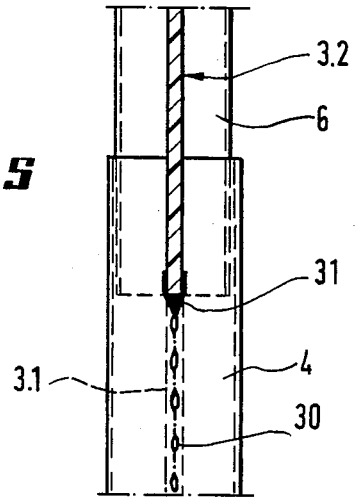
FIG. 15 is a view that shows a schematic longitudinal section through the connecting pipes including a perforation of the outer connecting pipe, and a device for opening the perforations.

FIG. 15 is a schematic longitudinal sectional view through the connecting pipes 4 and 6 during the introduction process. In this exemplary embodiment, rather than being slotted, the outer connecting pipe 4 is perforated. As the inner connecting pipe 6 is introduced, the perforation holes 30 are interconnected by means of a knife-like device 31 to form a continuous slot. This knife-like device 31 is attached to the bottom of the diaphragm 3.2 in the vicinity of the connection location 24.2.

Figure 16:
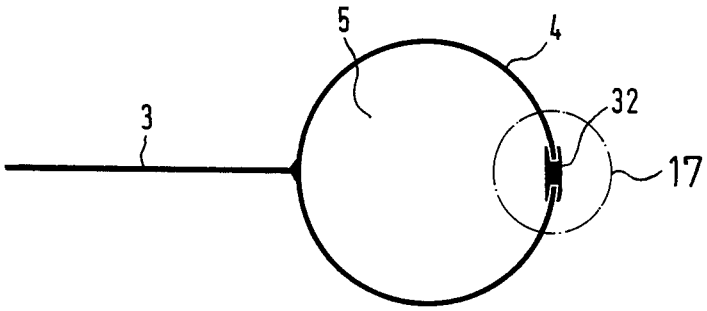
FIG. 16 is a schematic cross-sectional view through an outer connecting pipe and a device for protecting the slot of the outer connecting pipe.
Figure 17:
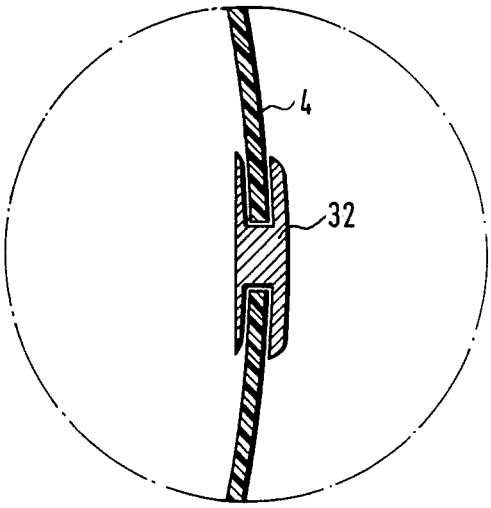
FIG. 17 is a schematic sectional view through the device for protecting the slot of the outer connecting pipe.

An exemplary support device for the slot of the outer connecting pipe 4 is shown in FIG. 16. This support device comprises a removable profiled member 32 which surrounds the edges of the entire slot of the outer connecting pipe 4. The profiled member 32 can be made of metal or synthetic material, and protects the slot from damage and/or imparts to the outer connecting pipe 4 additional stability during placement into the slotted wall.

Figure 18:
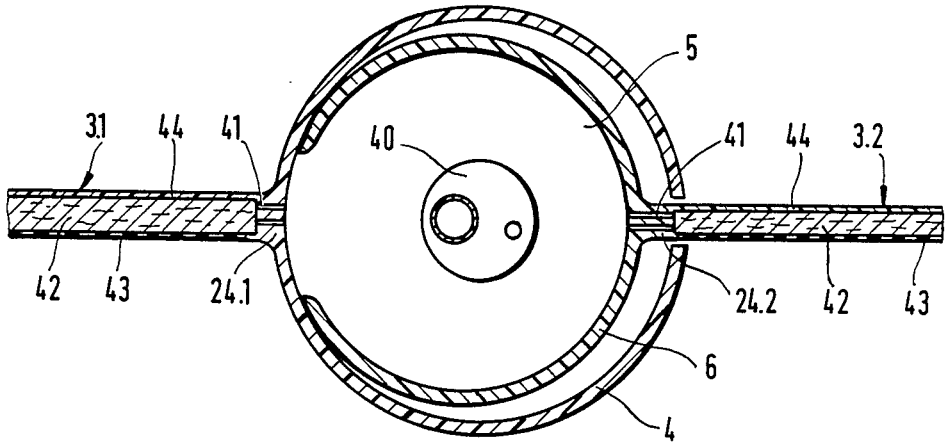
FIG. 18 is a schematic cross-sectional view through the connecting pipes and multi-layered diaphragms.

FIG. 18 shows an exemplary embodiment of the inventive device as used with a multi-layered diaphragm. In this embodiment, the diaphragm comprises a drainage layer 42, a filter fleece 43, and a thin but dense sheet 44. Hole-like openings 41 between the drainage layer 42 and the interior 5 of the connecting pipes 4 and 6 are produced at the connection locations 24.1 and 24.2 of the multi-layered diaphragms 3.1 and 3.2 to the connecting pipes 4 and 6. To withdraw seepage water, an underwater pump 40 can be installed in the interior 5 of the connecting pipes 4 and 6. Due to the reduction of the fluid resistance in the drainage layer connected herewith, the drainage layer functions as a "hydraulic trap" for seepage water and diffusing gases, so that a further penetration of the slotted wall is prevented. The underwater pump 40 can be installed only temporarily, or only in each fifth or tenth connecting pipe. In the latter case, the interiors 5 of the other connecting pipes serve as a space through which fluid can flow to the next suction device. Furthermore, samplers or gauges for determining the water level ca be provided in the interiors 5 of the connecting pipes 4 and 6.

Figure 19:
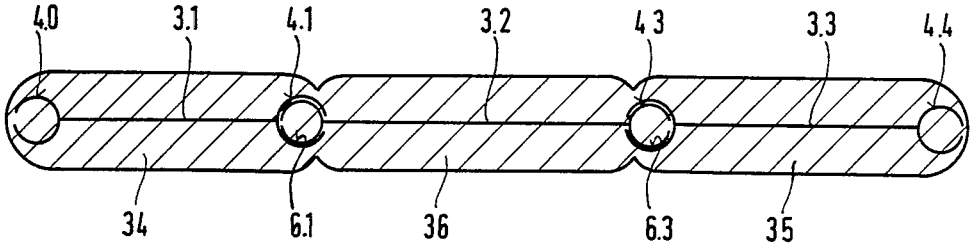
FIG. 19 is a schematic plan view of several slotted-wall sections during manufacture of the slotted wall pursuant to the pilgrim step method.

FIG. 19 shows a plurality of slotted-wall sections during the manufacture thereof in a pilgrim step rolling process. First, the primary sheets 34 and 35 were produced; each of the diaphragms 3.1 and 3.2 are provided at their left and right vertical edges with outer connecting pipes 4.0, 4.1, 4.3, and 4.4. Subsequently, the secondary sheets 36 are sunk along the connecting pipes 4.1 and 4.3, and a diaphragm 3.2 is introduced. The left and right vertical edges of the diaphragm 3.2 are provided with inner connecting pipes 6.1 and 6.3, which are introduced into the outer connecting pipes 4.1 and 4.3 as the diaphragm 3.2 is positioned in the secondary sheet 36. As the manufacture of the slotted wall proceeds, first the primary sheets are produced, and subsequently the secondary sheets for placement therebetween are produced. Not illustrated is a variation of this embodiment where additional pipes 29 are used as was described in connection with FIG. 14. For such an embodiment, respective additional pipes of this type are provided on the vertical edges of the primary sheets; the outer connecting pipes 4.0, 4.1, 4.3, and 4.4 are disposed in the ring-shaped recessed portions of these additional pipes.

Figure 24:
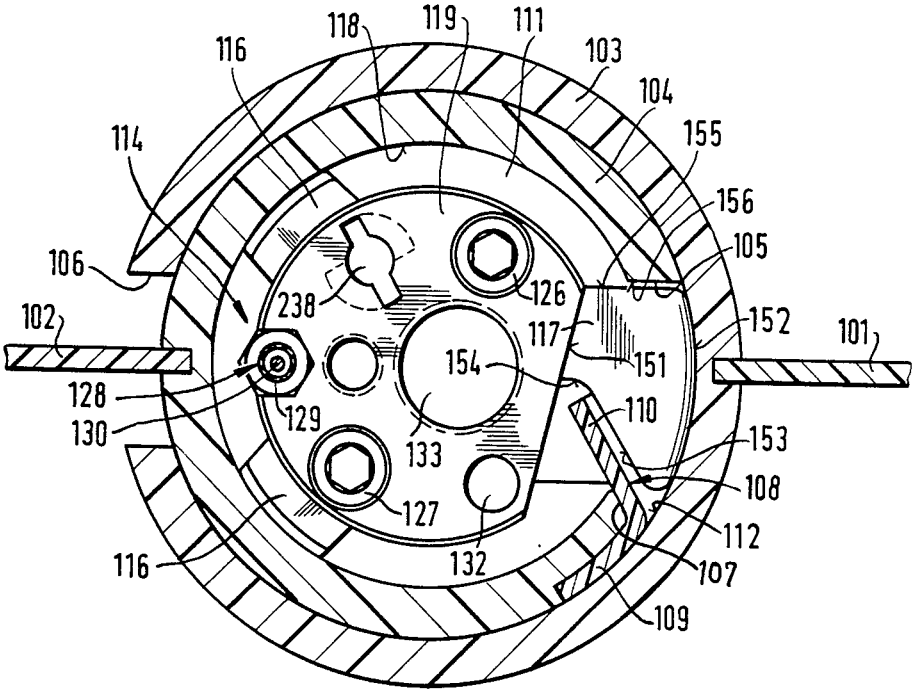
FIG. 24 is a view that shows a section taken along the line 24—24 in FIG. 22.

As shown in the exemplary embodiment of FIG. 24, the connecting pipes 103, 104 are permanently and sealingly attached to the vertical edges of the diaphragms 101, 102 as previously described in detail. Each of the two connecting pipes 103,104, which extend over the entire length of the diaphragms 101, 102, are provided with a longitudinal slot 105, 106. The outer connecting pipe 103 has a greater diameter than does the inner connecting pipe 104, the outer wall of which rests against the inner wall of the outer connecting pipe 103. The diaphragm 102 of the inner connecting pipe 104 extends through the longitudinal slot 106 of the outer connecting pipe 103. In the installed state, the two longitudinal slots 105, 106 of the connecting pipes 103, 104 are disposed diametrically opposite one another. Furthermore, the diaphragms 101, 102 are disposed in a common plane.

Pursuant to a preferred embodiment, the diaphragms 101, 102, and the connecting pipes 103, 104, are made of a fluid-impermeable synthetic material, such as polyvinyl chloride, polypropylene, or polyethylene having a low or high density. Thermoplastic elastomers on a base of natural or synthetic rubber can also be used for the diaphragms 101, 102; these materials generally have a greater diffusion resistance.

To connect the two pipes 103,104 to one another, a profiled fusing or welding piece 108 (FIG. 24) is secured in the outer wall of the inner connecting pipe 104 in the vicinity of the longitudinal edge 107 which delimits the longitudinal slot 105 In the starting position, prior to the fusing, the profiled piece 108 has an approximately L-shaped cross-section. The leg 109 of the profiled piece 108 is disposed in the outer side of the inner connecting pipe 104 and is flush with the outer surface thereof, while the other leg 110 of the profiled piece 108 extends at an angle through the longitudinal slot 105 in the connecting pipe 104. When the hollow space 111 enclosed by the two connecting pipes 103, 104 is freed of the suspension, the leg 110 of the profiled piece 108 is fused to the inner wall 112 of the outer connecting pipe 103. The fused location 113 (FIGS. 31 and 32) formed thereby provides a tight connection between the two connecting pipes 103, 104 over the entire length of the latter.

Figure 20:
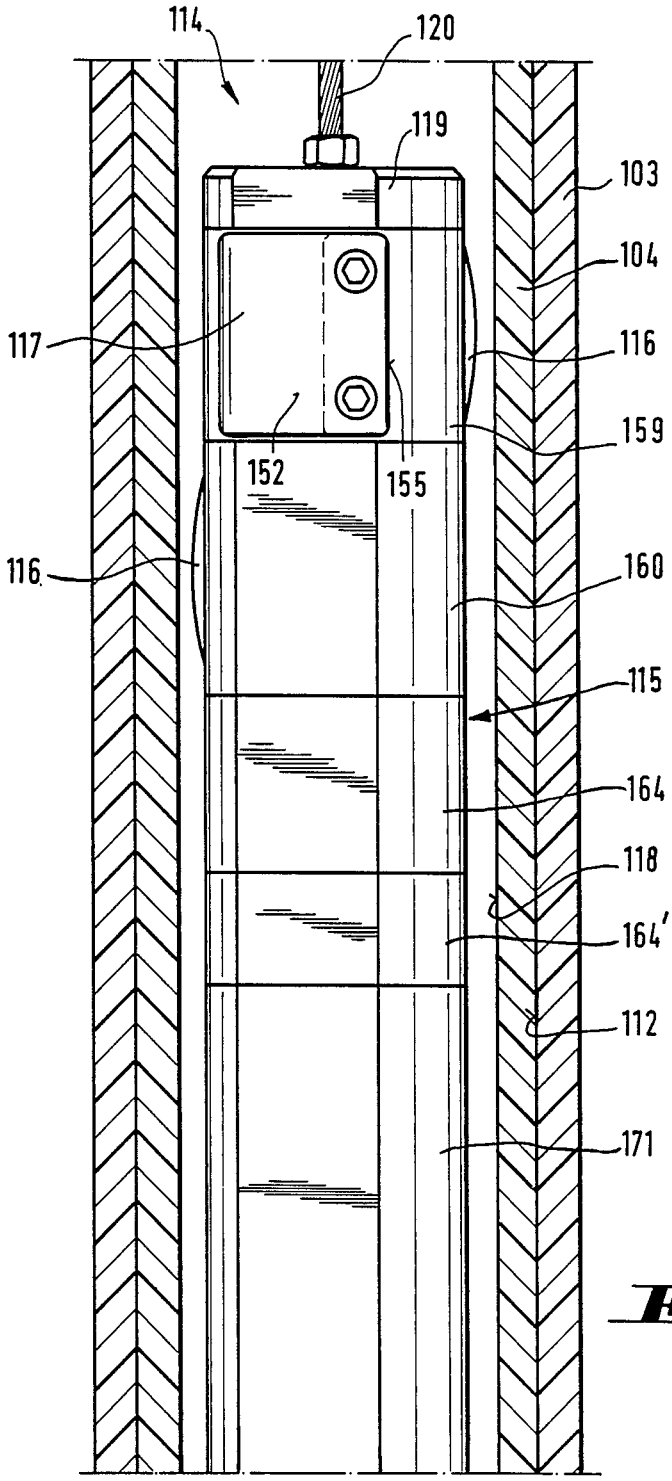
FIG. 20 is a view of the upper half of one inventive embodiment of the device which is disposed in the connecting pipes which are to be fused to one another.

To effect fusing, a fusing device 114 (FIGS. 20 and 21) is introduced into the interior of the connecting pipe 104. The fusing device 114 has an elongated housing 115 which has an essentially circular cross-section, and is provided with pressure members 116 and guides 117 (FIG. 24 and others) which are distributed over the periphery and over the length of the housing 115. The pressure members 116 and the guides 117 project radially out of the housing, and provide support for the fusing device 114 against the inner wall 118 of the inner connecting pipe 104, and against the inner wall 112 of the outer connecting pipe 103. The housing 115 has an upper end plate 119 (FIG. 20) to which is secured a pulley member 120, for example a draw cable, with which the fusing device can be lowered into, and again withdrawn from, the connecting pipe 104. The fusing device is provided with a heating device 121 (FIG. 21) with which the leg 110 of the profiled piece 108, and the associated region of the connecting pipe 103, are heated as the fusing device 114 is raised. Mounted to the housing 115 after the heating device 121 when viewed in the raising direction 122 (FIG. 21) is a deforming member 123 which places the heated leg 110 of the profiled piece 108 against the inner wall 112 of the outer connecting pipe 103 when the fusing device 114 is being raised. Disposed directly after the deforming member 123 when viewed in the raising direction 122 is a pressing member 124 which securely presses the leg 110 of the profiled piece 108, which leg 110 is already placed against the inner wall 112 of the outer connecting pipe 103, against said inner wall of the outer connecting pipe , so that an intimate connection between the leg of the profiled fusing piece and the outer connecting pipe occurs. Spaced after the pressing member 124 when viewed in the raising direction 122 is a further pressing member 125 with which the leg 110 of the profiled piece 108 is again securely pressed against the inner wall 112 of the outer connecting pipe 103. This pressing member 125 is also mounted to the housing 115, and projects radially beyond the latter.

The upper end plate 119 is detachably connected on the housing with screws 126, 127 (FIG. 24). Mounted in the edge region of the end plate 119 is a Bowden control cable 128, the conduit 129 (FIG. 22) of which is detachably connected to the end plate 119, and the pull cable 130 of which is guided all the way to the deforming member 123 (FIG. 23) through a bore 131 which extends axially through the housing 115 The end plate 119 is furthermore provided with an opening 132 (FIG. 24) for non-illustrated electrical cables which are conveyed to the heating device 121 The end plate 119 is also provided with an opening 133 through which a hose 134 (FIG. 22) is guided which conveys cold air axially through the housing 115 to the heating device 121.

When viewed in the axial direction of the housing 115, the pressure members 116 and the guides 117 are uniformly distributed over the periphery of the housing (FIG. 24) The pressure members 116 are identical, and are loaded radially outwardly under the force of respective compression springs 135 (FIGS. 25 and 26), so that in the position of use of the fusing device 114, the pressure members 116 rest against the inner wall 118 of the inner connecting pipe 104 with prestress. The pressure members 116 have a rounded outer surface 136 (FIGS. 22, 25, and 26) with which they rest against the inner wall 118 of the inner connecting pipe 104 The outer surface 136 is curved in the longitudinal and transverse directions of the pressure member 116 The latter is essentially cup shaped, and has a rectangular contour when viewed in elevation. The longitudinal sides 137 and 138 (FIG. 25) of the pressure members 116 extend in the axial direction of the housing 115 and are guided along axially extending sidewalls 139, 140 of a recess 141 of the housing 115. The longitudinal sides 137, 138 of the pressure members 116 are connected by narrow sides 142, 143 (FIG. 26) which extend at right angles to the longitudinal sides and are spaced from the sidewalls 144, 145 of the recess 141, which sidewalls extend parallel to the narrow sides 142, 143. The sidewalls 137, 138, 142, 143 of the pressure members 116 are connected by a base 146 (FIG. 26) which is provided with the rounded outer surface 136 When viewed in cross-section, the curvature of the outer side 136 is the same as the curvature of the inner connecting pipe 104 (FIG. 25), so that the pressure member 116 is reliably guided in the transverse direction Since the outer side 136 of the pressure member 116 is also curved in the longitudinal direction (FIG. 26), not all of the outer surface 136 rests against the inner wall 118 of the inner connecting pipe 104. As a result, as the fusing device 114 is displaced in the connecting pipe 104, a tilting or catching is reliably prevented, so that tee fusing device can also be lowered and withdrawn without difficulty in long connecting pipes The sidewalls 137, 138, 142, 143 of the pressure member 116 are interconnected on that side opposite the base 146 by an insert 147 through which two threaded bolts 148 and 149 pass, the heads of which serve as abutments for the pressure members 116 One end of the compression spring 135 is supported against the base 150 of the recess 141 (FIGS. 25 and 26), and the other end of the spring rests against the inner side of the base 146 of the pressure member 116.

All of the pressure members 116 are preferably identical, with each one being under the force of a respective one of the compression springs 135. These springs press the pressure members 116 against the inner wall 118 of the inner connecting pipe 104. The maximum displacement of the pressure member 116 in the recess 141 is limited by the heads of the threaded bolts 148, 149, which serve as abutments. The pressure members 116 assure that the fusing device 114 is reliably guided in the connecting pipes 103, 104 and securely rests against the inner wall 118 of the inner connecting pipe 104.

Figure 22:
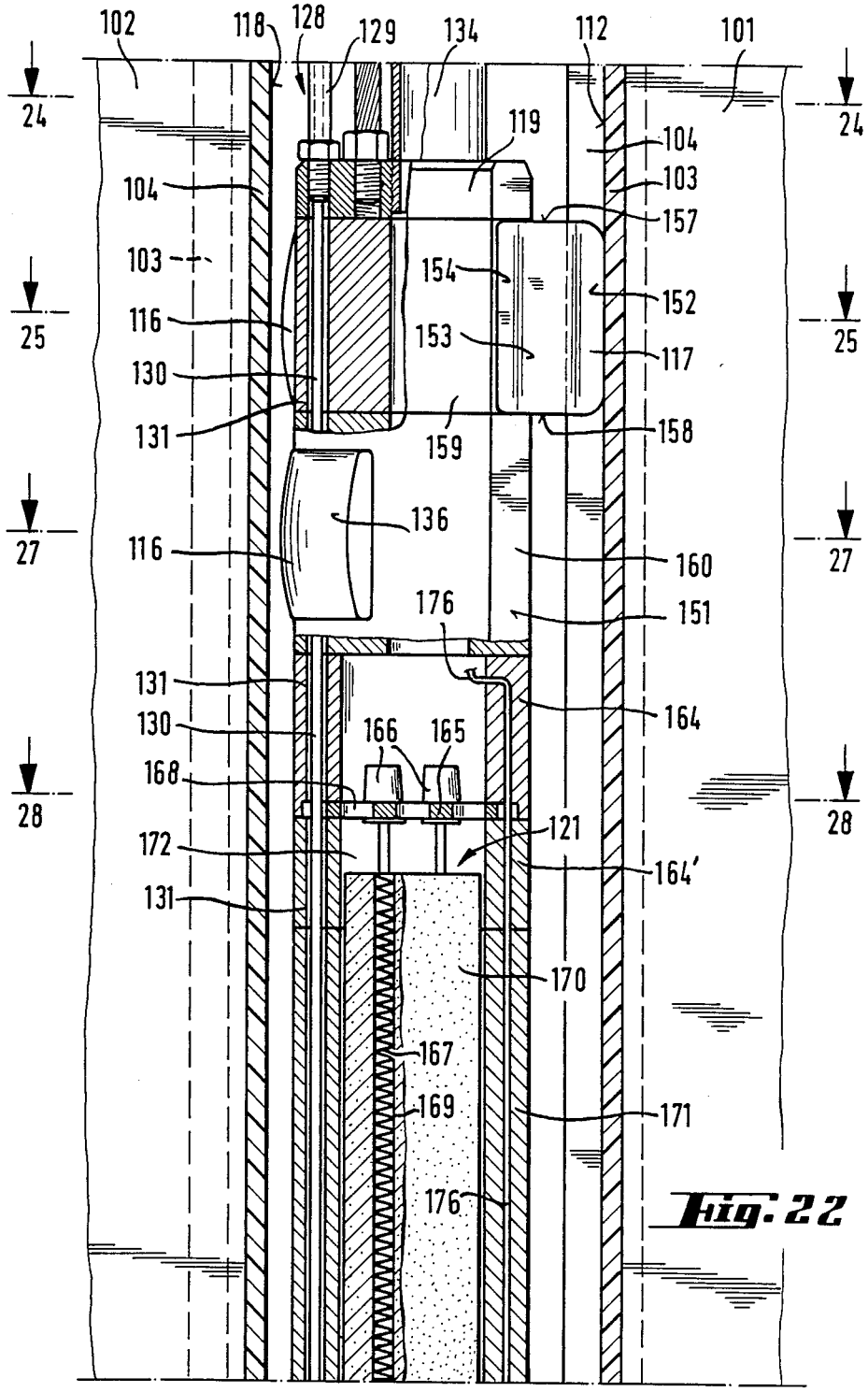
FIG. 22 is a view that shows a partial longitudinal sectional and partial elevational view of the upper half of the inventive device of FIG. 20.
Figure 23:
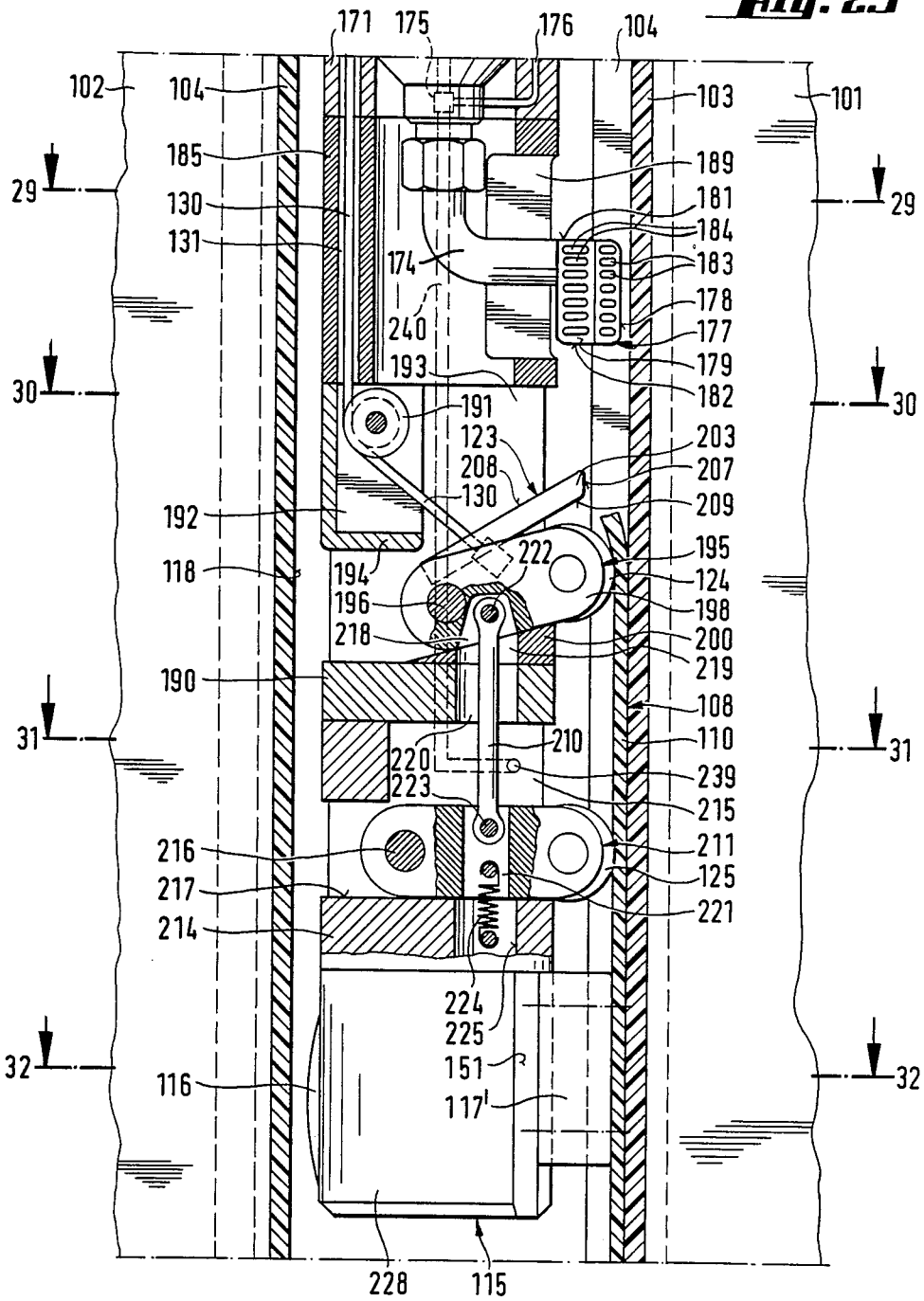
FIG. 23 is a partial longitudinal section and partial elevational view of the lower half of the inventive device of FIG. 20.

The guides 117, 117′ of the fusing device 114 are rigidly disposed on the housing 115 in the region of the profiled fusing piece 108 Since the one leg 110 of the profiled piece 108 initially projects inwardly into the connecting pipe 104, the housing 115 of the fusing device 114 is provided over its length with a flat portion 151 (FIG. 24) in the region of this leg, so that the fusing device 114 can be axially displaced in the connecting pipes 103, 104 without being obstructed by the leg 110. The guide 117 is also constructed in such a way that it does not come into contact with the inwardly projecting leg 110 of the profiled piece 108. The guides 117, 117′ are provided on the upper and lower ends of the housing 115 (FIGS. 22 and 23). These guides are disposed axially one above the other in the region of the profiled fusing piece 108. In the illustrated embodiment, the guides 117 are embodied as sliding shoes which project approximately radially from the housing 115 in the region of the flat portion 151. The guides 117 have a guide surface 152 which is curved in conformity to the outer connecting pipe 103, and with which the guides rest against the inner wall 112 of the outer connecting pipe. On that side which faces the leg 110 of the profiled piece 108, the guide surface 152 merges via a curve with an inclined planar surface 153 which is spaced from the leg 110 of the profiled piece 108 and may extend parallel thereto. The inclined surface 153 then merges via a rounded section into a side surface 154 which extends transverse to the flat portion 151 and is parallel to the opposite side surface 155, which also abuts the flat portion 151. The side surface 155 adjoins the guide surface 152 and is slightly spaced from the adjacent edge 156 of the inner connecting pipe 104, which edge 156 delimits the longitudinal slot 105. As shown in FIG. 22, at the axially upper and lower ends, the guide surface 152 merges in a continuously curved manner in upper and lower side 157 and 158. The upper guide 117 is disposed directly below the end plate 119, while the lower guide 117′ (FIG. 23) is spaced only slightly from the bottom end of the housing 115.

Figure 25:
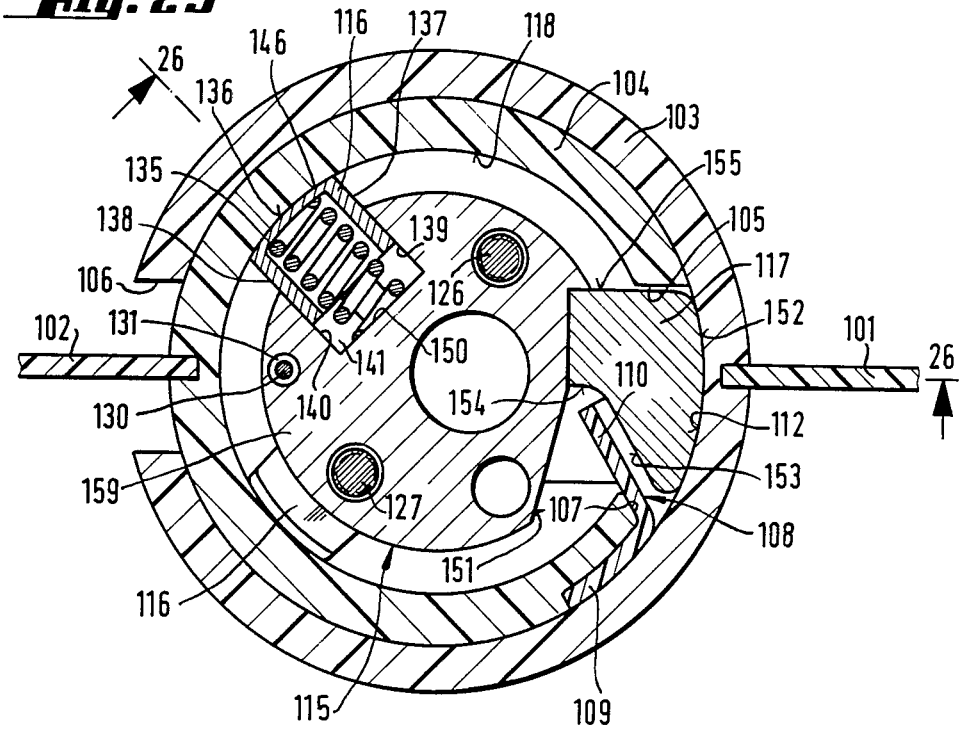
FIG. 25 is a view that shows a section taken along the line 25—25 in FIG. 22.
Figure 26:
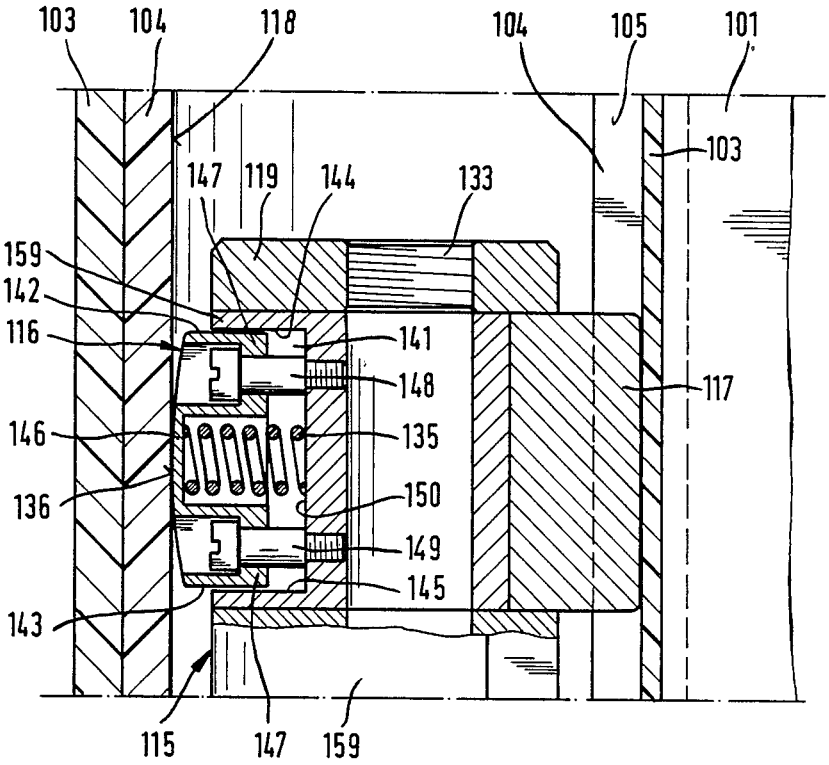
FIG. 26 is a view that shows a section taken along the line 26—26 in FIG. 25.

As a result of the described configuration, the sliding-shoe-like guides 117 engage under the leg 110 of the profiled piece 108. As it is placed in the connecting pipes 103, 104, the fusing device 114 is positioned in such a way that the guides 117 are disposed in the position illustrated in FIGS. 24 and 25 relative to the profiled fusing piece 108. If the leg 110 of the profiled piece extends further outwardly, as illustrated in FIGS. 24 and 25, it is pressed inwardly by the inclined surface 153 of the guide 117 during placement of the fusing device 114. In conjunction with the pressure members 116, which are under spring force, the guides 117, 117' assure a satisfactory guidance of the fusing device 114 in the connecting pipes 103, 104. As a result of the spring-loaded pressure members 116, an automatic centering of the fusing device in the connecting pipes is assured.

With the exception of the described openings or passages, the housing 115 is solid. As a result, the fusing device 14 has a stable construction.

Figure 27:
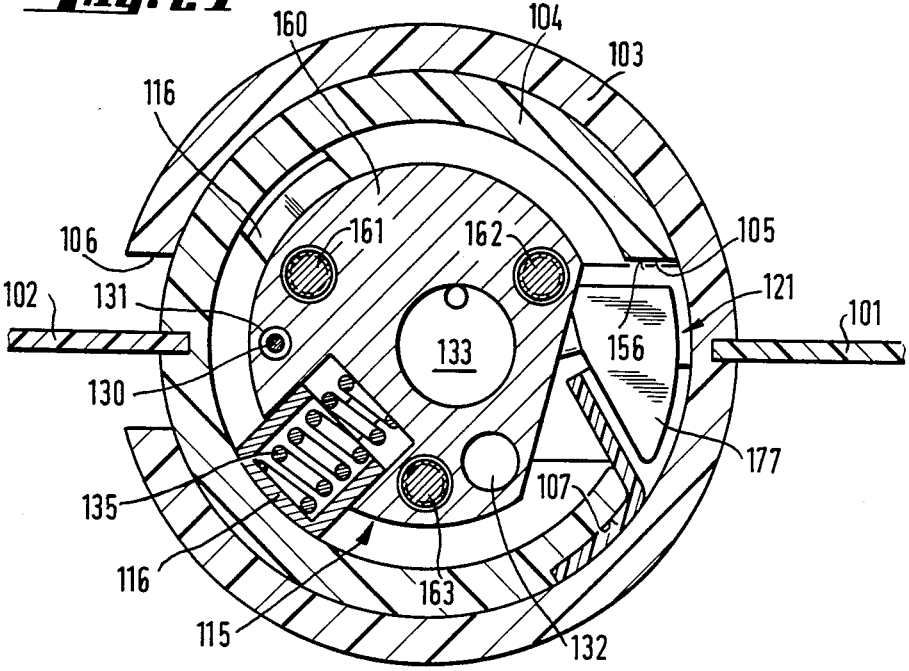
FIG. 27 is a view that shows a section taken along the line 27—27 in FIG. 22.

As can be seen in FIG. 22, directly below the end plate 119 the guide 117 and the pressure member 116 are disposed at the same axial height of the housing 115. Disposed slightly below them are a further pressure member 116 and guide 117 (FIGS. 22 and 27) which are angularly offset relative to the pressure members and guide disposed thereabove. As a result, a reliable guidance of the fusing device 114 in the connecting pipes 103, 104 is assured The upper pressure members 116 and the upper guide 117 are disposed in an upper housing portion 159 (FIG. 22), while the pressure members 116 and guide 117 located therebelow are disposed in a further housing portion 160. These two housing portions are interconnected by screws 161–163 (FIG. 27), which are preferably disposed at a uniform angular spacing relative to one another. Also axially passing through the housing portion 160 is the longitudinal bore 131 for the pull cable 130 of the Bowden control cable 128, and the openings 132 and 133.

Figure 28:
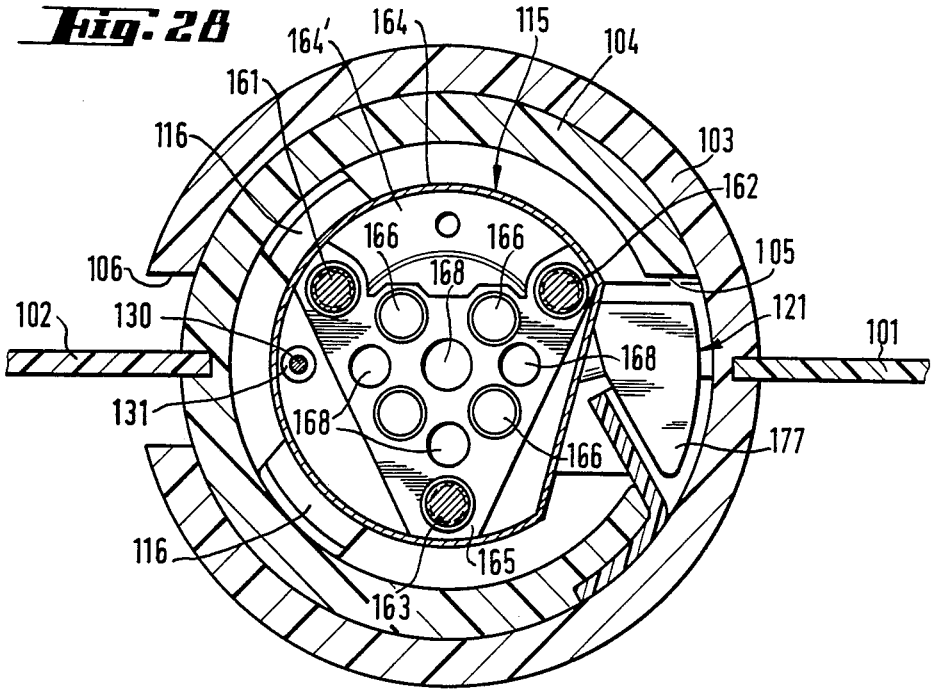
FIG. 28 is a view that shows a section taken along the line 28—28 in FIG. 22.

As shown in FIG. 22, the housing portion 160 is connected to a further housing portion 164, which is detachably connected to the former The housing portion 164 is seated on a distribution plate 165 (FIGS. 22 and 28), which has an essentially triangular contour and is secured between the housing portion 164 and a further housing portion 164' by means of the screws 161–163. Disposed on the distribution plate 165 are electrical connections 166 (FIG. 22 and 28) to which are guided the non-illustrated electrical cables which extend through the axial bore 132. Heating filaments 167 (FIG. 22) are connected to these connections 166. Also provided in the distribution plate 165 are air passage openings 168. The cold air which is supplied through the axial bore 133 passes through the openings 168 and into bores 169 (FIG. 22), in which the heating filaments 167 are accommodated. As shown in FIG. 28, the pull cable 130 of the Bowden control cable 128 extends directly next to the distribution plate 165.

The heating filaments 167 and the axial bores 169 are accommodated in a ceramic member 170 (FIG. 22), which is surrounded by a housing portion 171 which is detachably connected with the housing portion 164'. Both of the housing portions 164' and 171 are essentially in the form of cylinders. As shown in FIG. 22, the walls of these housing portions are thick enough that they can accommodate the longitudinal bore 131 for the pull cable 130. The ceramic member 170 projects into the housing portion 164' (FIG. 22). The heating filaments 167 extend over the entire length of the ceramic member 170, the end of which is axially spaced from the distribution plate 165. The cold air which flows through the air passage openings 168 into the distribution plate therefore first passes into a collecting chamber 172 provided between the distribution plate 165 and the ceramic member 170. From there the cold air flows through the bores 169 axially downwardly, during the course of which it is heated by the heating filaments 167. The ceramic member 170 and the heating filaments 167 form the heating device 121.

All of the bores 169 in the ceramic member 170 open into a supply line 174 (FIG. 23) connected to the bottom end of the ceramic member 170. Disposed in the flow path of the heated air is a thermocouple 175 (FIG. 23) for regulating the temperature of the air. The electrical lead 176 for the thermocouple 175 is guided upwardly through the wall of the housing portions 171, 164', and 164, and from there through the bore 132.

Figure 29:
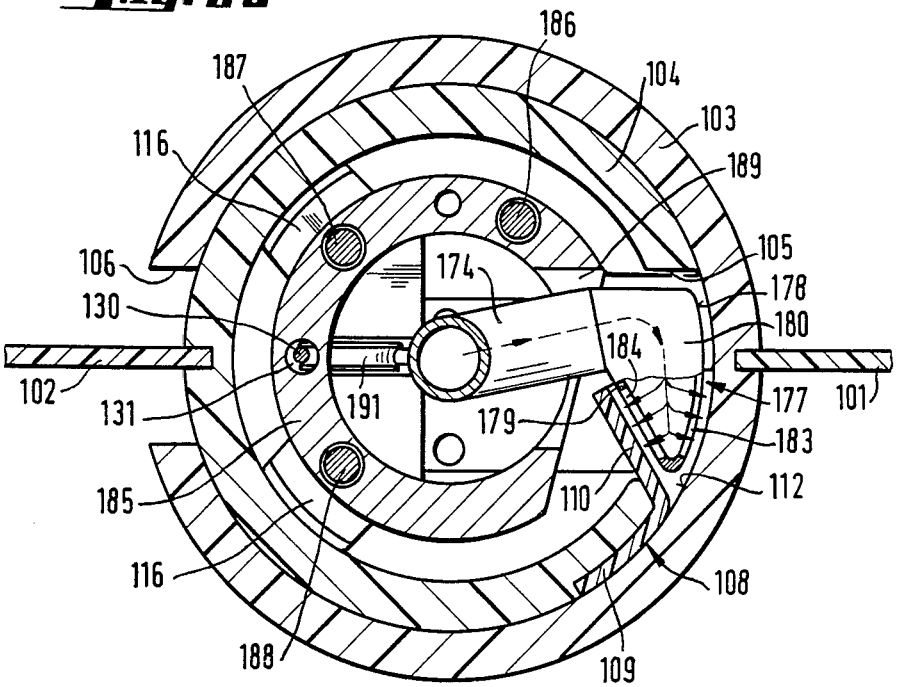
FIG. 29 is a view that shows a section taken along the line 29—29 in FIG. 23.

The supply line 174 connects the ceramic member 170 with a nozzle 177, which is also part of the heating device 121 and from which the heated air is directed upon the arm 110 of the profiled fusing piece 108. The nozzle 177 essentially has the same contour as does the upper guide 117 (FIG. 29). The nozzle 177 has an outer side 178 which is spaced from and parallel to the inner wall 112 of the outer connecting pipe 103 within the longitudinal slot 105 of the inner connecting pipe 104. The curved outer side 178 merges at that end which faces the leg 110 of the profiled piece 108 in a curved manner into an inclined surface 179 which is spaced from and parallel to the leg 110. The inclined side 179 and the outer side 178 form the outer sides of a nozzle body 180, which has planar upper and lower sides 181 and 182 which extend parallel to one another and are connected at right angles to the outer side 178 and the inclined side 179. The nozzle body 180 is disposed in a region beyond the housing 115. A plurality of outlet openings 183, 184, from which hot air can exit, are provided in the outer side 178, the inclined side 179, and in the transition region between these two sides. As shown in FIG. 23, the outlet openings 183, 184 are in the form of slots which extend parallel to one another and are disposed one above the other and transverse to the axial direction of the housing 115. The outlet opening 183, 184 are disposed in such a way that the hot air passes in the direction of the arrows in FIG. 29 over the entire width onto the leg 110 of the profiled piece 108, onto the corresponding width of the wall 112 of the outer connecting pipe 103, and onto the transition region from the leg 110 to the leg 109 of the profiled fusing piece 108. As a result of heating the transition region, a yielding hinge is formed which reduces the restoring forces when the leg 110 is deflected. The outlet openings 183, 184 can also be round, or can have any other desired shape.

Figure 21:
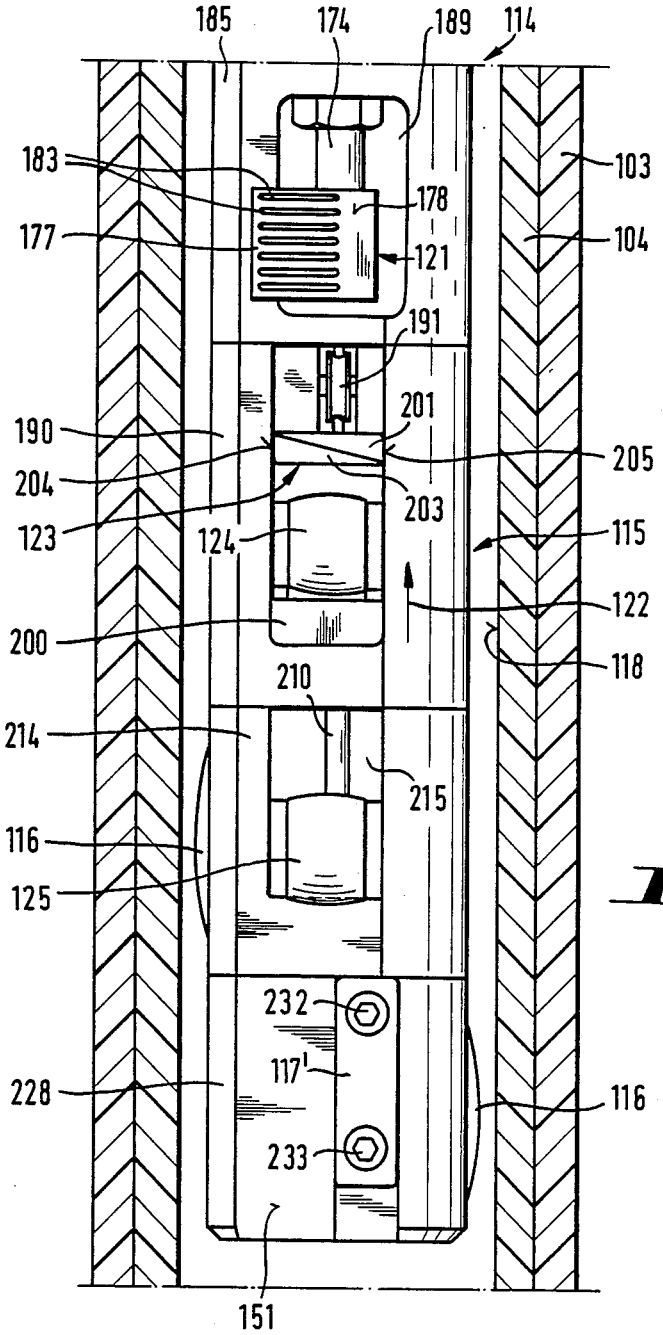
FIG. 21 is a view that shows the lower half of the inventive device of FIG. 20.

The supply line 174 is surrounded by a cylindrical housing portion 185 which is spaced therefrom, and which is detachably connected with the housing portion 171 via screws 186 - 188 (FIG. 29). The longitudinal bore 131 for the pull cable 130 of the Bowden control cable 128 also passes axially through the wall of the housing portion 185. To allow the supply line 174 to pass through, the housing portion 185 is provided with a rectangular opening 189 (FIG. 21, 23, and 29).

Figure 30:
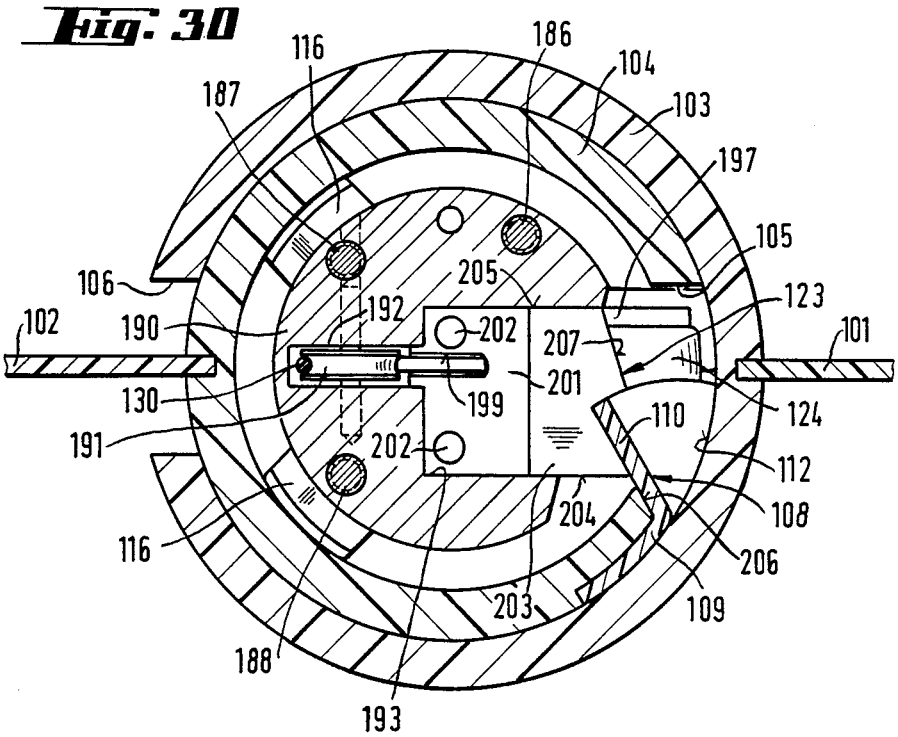
FIG. 30 is a view that shows a section taken along the line 30—30 in FIG. 23.

Connected to the housing portion 185 is a further housing portion 190 which is essentially solid (FIG. 30). Accommodated therein are the deforming member 123, the pressing member 124, and a guide roller for changing the direction of the pull cable 130 of the Bowden control cable 128. The guide roller 191 is accommodated in a slot-like chamber 192 of the housing portion 190. The chamber 192 extends approximately radially, and merges with a considerably wider chamber 193 in which the deforming member 123 and the pressing member 124 are accommodated. The chamber 192, in which the guide roller 191 is freely rotatably mounted, is closed off at the bottom by a transverse wall 194 (FIG. 23). At the guide roller 191, the pull cable 130 is guided to a bracket 195 which is pivotably mounted in the chamber 193 about a spindle 196 which is disposed at right angles to the axial direction of the housing 115. The bracket 195 projects out of the chamber 193 above the housing portion 190, and carries on its end which projects out the pressing member 124, which is disposed between two arms 197, 198 of the bracket (FIGS. 23, 30). The pull cable 130 is connected to the bracket 195, to which the deforming member 123 is also connected. The deforming member 123 has a longitudinal slot 199 (FIG. 30) through which the pull cable 130 extends. In the illustrated embodiment, the pressing member 124 is a roller which has a rounded surface and is mounted freely rotatably between the bracket arms 197, 198. As shown in FIG. 23, in the starting position the bracket 195 is disposed on a ramp 200 which is accommodated in the chamber 193 and continuously rises to the outside of the housing portion 190. The deforming member 123 is plate-shaped, and has the same width as does the bracket 195. The rectangular section 201 disposed within the housing portion 190 (FIG. 30) is detachably connected to the bracket 195 via screws 202. The section 201 has a rectangular contour, and merges into an end section 203 which is trapezoidal in plan view (FIG. 30), projects out of the chamber 193, and presses the leg 110 of the profiled fusing piece 108 against the inner wall 112 of the outer connecting pipe 103. As shown in FIG. 21, the thickness of the end section 203 continuously decreases from one longitudinal side 204 to the opposite longitudinal side 205. As shown in FIG. 30, the longitudinal side 204 of the end section 203 is that side of the deforming member 123 which faces that longitudinal edge 206 of the longitudinal slot 105 of the inner connecting pipe 104 which is provided with the profiled piece 108. When the fusing device 114 is raised in the connecting pipes 103, 104, the end section 203 presses the inwardly directed arm 110 of the profiled piece 108 outwardly toward the inner wall 112 of the outer connection pipe 103. The end face 207 of the end section 203 extends at such an angle that it has its greatest spacing from the inner wall 112 of the outer connecting pipe 103 at the longitudinal side 204, and has its greatest spacing at the longitudinal side 205 (FIG. 30). The upper side 208 (FIG. 23) of the end section 203 merges in a continuously curved manner into the end face 207, which forms an acute angle with the upper side 208 and an obtuse angle with the under side 209 of the end section 203. The described configuration of the end section 203 makes it possible to reliably engage the inwardly extending leg 110 of the profiled piece, and to bend the leg 110 outwardly in the direction of the outer connecting pipe 103. By means of the directly following pressing member 124, this leg 110 which is bent and held outwardly by the deforming member 123 is pressed tightly against the inner wall 112 of the outer pipe 103, and is fused therewith. As a result of the ramp 200, the bracket 195 along with the pressing member 124 are inclined upwardly at an angle. The deforming member 123 is also inclined upwardly at an angle, but at a greater angle than is the bracket 195 (FIG. 23). When the fusing device is pulled up, the ramp 200 forms a support upon which the bracket 195 can be supported when its pressing member 124 presses the outwardly bent leg 110 of the profiled piece 108 against the inner wall 112 of the outer connecting pipe 103. This assures that the leg 110 is pressed reliably and tightly against the outer connecting pipe.

Figure 31:
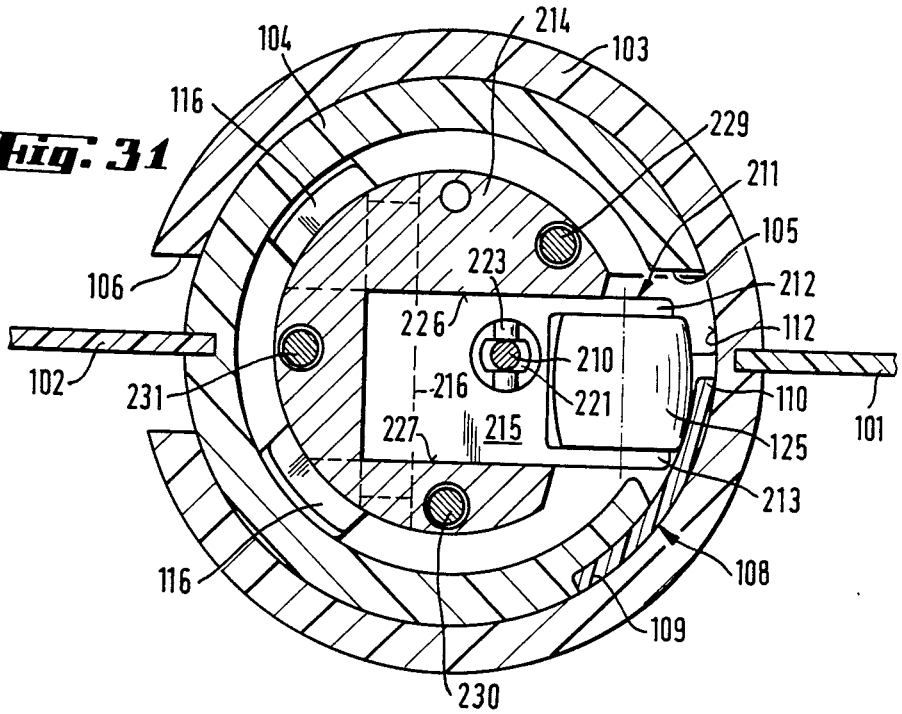
FIG. 31 is a view that shows a section taken along the line 31—31 in FIG. 23.

The bracket 195 is hinged by a tie rod 210 (FIG. 23) to a further bracket 211; the pressing member 125 is mounted between the parallel arms 212, 213 of the bracket 211 (FIG. 31). In the illustrated embodiment, the pressing member 125 is also a freely rotatable roller having a rounded surface. The bracket 211 is accommodated in a further housing portion 214 (FIGS. 21 and 23), which is essentially solid. The housing portion 214 has a single chamber 215 (FIG. 31) for receiving the bracket 211. The bracket arms 212, 213 project outwardly from the chamber 215 beyond the housing 115. Like the bracket 195, the bracket 211 is pivotable about a spindle 216 which is disposed at right angles to the longitudinal axis of the housing 115. The spindle 216 is spaced a greater distance from the profiled piece 108 than is the pivot spindle 196 of the bracket 195 (FIG. 23). In the rest position, the bracket 211 is supported on a base 217 of the chamber 215. The upper bracket 195 is provided on that side which faces the lower bracket 211 with a recess 218 in which the tie rod 210 is attached. The latter passes through bores 219 and 220 in the ramp 200 and in the housing portion 119 with clearance, and projects into an axially extending bore 221 which passes through the bracket 211, and in which the tie rod is connected to the latter. The pivot spindles 222, 223 provided at the ends of the tie rod 210 are disposed parallel to one another and at fight angles to the longitudinal axis of the housing.

Furthermore, the lower bracket 211 is pulled against the base 217 of the housing portion 214 by means of a tension spring 224. One end of the spring 224 is connected to the bracket 211 within the bore 221, and the other end of the spring is connected within a bore 225 of the housing portion 214.

As shown in FIG. 31, the bracket 211 is guided along the sidewalls 226 and 227 of the chamber 215. The recess 218 and the bore 221 are off-centered to the extent that they are closer to the longitudinal side 205 or the sidewall 226 than to the opposite longitudinal side 204 or the sidewall 227. The chamber 215 is open over its entire length in the direction toward the longitudinal slot 105 of the inner connecting pipe 104 (FIG. 21).

Figure 32:
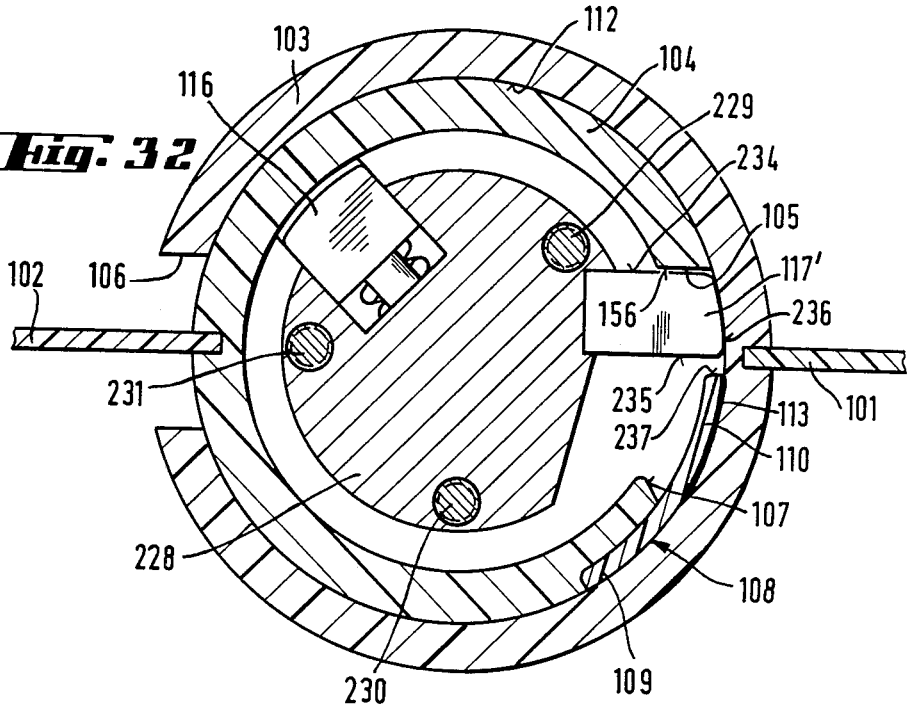
FIG. 32 is a view that shows a section taken along the line 32—32 in FIG. 23.

Connected to the housing portion 214 is an essentially solid end housing portion 228, which is again detachably connected to the housing portion 214 with screws 229–231. The pressure member 116 and the guide 117' are mounted in the housing portion 228 (FIG. 32). The guide 117' has a different shape than does the sliding-shoe-like guide 117, because when the fusing device 114 is pulled up, the guide 117' does not come into contact with the outer connecting pipe 103 until the leg 110 of the profiled fusing piece 108 is already fused to the outer connecting pipe. As shown in FIGS. 23 and 32, the guide 117' extends over nearly the entire height of the housing portion 228, to which it is detachably connected by screws 232, 233 (FIG. 21). The guide 117' has parallel longitudinal sides 234 and 235 (FIG. 32) which in a rounded-off fashion merge into an end face 236. The latter is curved in such a way that it rests over its entire width against the inner wall 112 of the outer connecting pipe 103. The guide 117' is spaced slightly from the longitudinal edge 156 of the longitudinal slot 105, and is also spaced from the end face 237 of the leg 110 of the profiled piece 108, which leg 110 is fused onto the outer connecting pipe 103.

When the two connecting pipes 103 , 104 are placed within one another, and the interior which they enclose is freed of the filled-in suspension, the fusing device 114 is lowered down into the connecting pipes. The fusing device 114 is suspended on the pulling member 120, and slides downwardly to the connecting pipes as a result of own weight. If the fusing device does not easily slide downwardly, the downward movement can be supplemented with a push rod or the like. For this purpose, the end plate 119 (FIG. 24) is provided with a profiled insertion opening 238 through which the corresponding profiled portion of the push rod can be inserted. After insertion, this profiled portion is rotated by 90°, so that a positive connection is produced between the push rod and the housing 115 of the fusing device 114. The device 114 can then be pushed down by the push rod without difficulty. The fusing device 114 is arranged in such a way that the guides 117, 117' extend within the longitudinal slot 105 of the inner connecting pipe 104 and rest against the inner wall 112 of the outer connecting pipe 103. Due to the sliding-shoe construction of the guides 117, as well as the narrow construction of the guide 117', the guides do not come into contact with the inwardly projecting leg 110 of the profiled piece 108 while the fusing device is being lowered. The spring-loaded pressure member 116 assures that the fusing device 114 is automatically centered in the connecting pipes 103, 104. So that during lowering of the device the pressing members 124, 125 do not come into contact with the inwardly projecting leg 110 of the profiled piece 108, these pressing members are pivoted upwardly via the Bowden control cable 128 out of their operating position illustrated in FIG. 23, counterclockwise about the spindles 196 and 216, into a non-operative position. In so doing, the deforming member 123 is also taken along. By means of the tie rod 210, both of the brackets 195, 211 are pivoted upwardly at the same time by the Bowden control cable 128. Since the heating device 121 with the nozzle body 180 has nearly the same construction as do the sliding-shoe-shaped guides 117, the nozzle body also does not come into contact with the leg 110 of the profiled piece 108 during lowering. As soon as the fusing device 114 has been lowered into its bottom end position, the Bowden control cable 128 is released. Under the force of the tension spring 224, the bracket 215, and via the tie rod 210 also the bracket 195 with the deforming member 123, are then pivoted back into their operating position illustrated in FIG. 23. The heating filaments 167 are now heated, and air is conveyed via the supply line 134 and through the bores 169. As the air passes through these bores, it is heated by the heating filaments 167 and exits from the outlet openings 183, 184 of the nozzle body 180. The hot air is then directed against that inner side of the leg 110 which faces the outer connecting pipe 103, and also against the opposite region of the inner wall 112 of the outer connecting pipe. The leg 110, and that region of the inner wall 112 of the outer connecting pipe 103 which is intended for supporting the leg 110, are thus heated to that temperature which is required for fusing. The air temperature can be measured and precisely adjusted with the thermocouple 175. The fusing device is now continuously pulled up by means of the pulling member 120. Those parts of the leg 110 of the profiled piece 108 which are heated by the heating device 121 are bent outwardly during the pulling-up process by the following deforming member 123 in the direction toward the heated region of the inner wall 112 of the outer connecting pipe 103. Immediately thereafter, that region of the leg 110 which has been bent outwardly and held in this position by the deforming member is pressed and thereby fused by the immediately following pressing member 124 securely against the heated region of the inner wall 112 of the outer connecting pipe 103. The fused region 113 is illustrated in FIG. 31.

In order to rapidly cool the fused regions, the opening 239 of a cold air line 240 (FIG. 23) is disposed in the region between the two pressing members 124 and 125; cold air for cooling the fused parts can be supplied through this opening 239. The cold air contacts the fused location 113 and cools the fused parts. Subsequently, by means of the pressing member 125, the fused region of the leg 110 of the profiled piece 108 is again firmly pressed against the inner wall 112 of the outer connecting pipe 103. This assures a tight fused connection between the profiled fusing piece 108 and the outer connecting pipe 103. This described fusing process takes place continuously as the fusing device 114 is pulled up. During this pulling-up process, counterforces which act downwardly against the pulling are exerted upon the brackets 195, 211; these counterforces are reliably accommodated by the ramp 200 and the base 217 of the housing portion 214.

In the just described and illustrated embodiment, the profiled fusing piece 108 is provided only on one edge of the longitudinal slot 105 of the inner connecting pipe 104. However, it is also possible to provide such a profiled piece on the opposite longitudinal edge 156 of the longitudinal slot 105. The nozzle body 180 and the guides 117, 117' are then appropriately constructed so that during lowering of the fusing device the legs are not unintentionally deformed, and when the fusing device is pulled up the hot air can reach both of the inwardly directed legs of the profiled pieces. The pressing members 124, 125 and the deforming member 123 are also constructed in such a way that they can simultaneously press both of the legs outwardly against the outer connecting pipe 103.

Pursuant to another, non-illustrated, embodiment, the pressing member 124 also serves as the deforming member, so that the deforming member 123 can be dispensed with. When the device is pulled up, the pressing member 124 deflects the heated leg 110 of the profiled piece 108, thereby pressing it firmly against the outer connecting pipe 103. In other respects, such an embodiment corresponds to the previously described embodiment. In order to prevent the heated region of the leg 110 of the profiled piece 108 from bulging outwardly, it is expedient to provide for the leg 110 at least one guide which is disposed in the region above the heating device 121 and extends nearly to the latter. Such a guide has a cross-section which is nearly identical to that of the guide 117, but is spaced closer to the outer connecting pipe 103.

In the embodiment of FIGS. 33 to 35, the two connecting pipes 303, 304 are tightly interconnected in the region of the longitudinal slots 305 and 306 by extrusion welding. When the interior 307 enclosed by the two connecting pipes 303, 304 is freed of the suspension, the inner connecting pipe 304 is fused by extrusion welding along the longitudinal edges 308 and 309, which delimit the slot 305, via respective weld seams 310, 311 to the inner wall of the outer connecting pipe 303. The weld seams 310, 311 provide a tight interconnection over the entire length of the two connecting pipes 303, 304.

To effect the fusing, a fusing device 312 is introduced into the interior of the connecting pipe 304 (FIG. 33). This fusing device has an elongated housing 313 which has an essentially circular cross-section, and is provided with pressing members 314 and guides 315 which are distributed over its periphery and over its length. The pressing members and guides project radially out of the housing 313, and support the fusing device 312 against the inner wall 316 of the inner connecting pipe 304 and against the inner wall 317 (FIG. 33) of the outer connecting pipe 303. The housing 313 has an upper end plate 318 (FIG. 33) to which is connected a non-illustrated pulling member, for example a pulling cable, with which the fusing device can be lowered into, and again withdrawn from, the connecting pipe 304. If during lowering the fusing device 312 does not slide downwardly easily, the downward movement can be supplemented with a push rod or the like. For this purpose, the end plate 318 is expediently provided with a non-illustrated, profiled insertion opening through which a correspondingly profiled portion of the push rod can be inserted. After insertion, the push rod is rotated by, for example, 90°, so that a positive connection is formed between the push rod and the housing 313 of the fusing device 312. The device 312 can then be pushed downwardly with the push rod without difficulty.

Accommodated radially one after the other in the housing 313 are a heating device 319, a motor 320 for an extruder screw 321, and a welding shoe 322 from which exits the welding material required for fusing the two connecting pipes 303, 304 to one another. The heating device 319 is mounted centrally in the housing 313 in two successive, spaced apart cylindrical frames 323 and 324. The heating device 319 has a cylindrical housing 325 through which extends a supply line 326 through which the air which is to be heated up is supplied. The air flows downwardly in the line 326 in the direction of the arrow 327. The supply line extends upwardly through the connecting pipes 303, 304 to non-illustrated control elements for the supply of power and air. Spaced above the housing 325, the air supply line is supported within the housing 313 and at least one further frame 328 which, just like the frames 323, 324 for the housing 325 of the heating device 319, is mounted on the inner wall of the housing 313. Also disposed in the housing 325 of the heating device 319 are non-illustrated heating elements which heat the air which flows through the line 326 to the required fusing temperature. Heating cables 329 are provided for supplying power to the heating elements; these heating cables are also guided upwardly to the control elements. The housing 325 has a smaller diameter than does the housing 313 of the fusing device 312, so that it is spaced all the way around from the inner wall of the housing 313.

The motor 320, which is disposed below the heating device 319 at a distance therefrom, is mounted on a support 330 which is mounted on the inner wall of the housing 313 of the fusing device 312. The support 330 has a central opening for a drive shaft 331 of the motor 320. This shaft is rotatably supported in the region below the support 330 in at least one bearing 332, which is mounted in a conically tapering support body 333 and is axially secured by means of a securing disk 334. The support body 333 is disposed at a slight distance below the support 330, and has a central recess for the bearing 332, which is inserted into the support body 333 from above. The support body 333 is mounted to the inner wall of the housing 313, and tapers toward the bottom. The support body 333 merges into a cylindrical part 335 in which the extruder screw 321 is accommodated.

The extruder screw 321 comprises a granulating part 336, which is connected directly to the drive shaft 331, and a transport member 337. The granulating part 336 is accommodated in the support body 333, while the transport member 337 is surrounded by the cylindrical part 335. The transport part 337 ends at a distance from an end part 338 which has a central extension 339 on which the cylindrical part 335 is seated. As shown in FIG. 33, the outside of the extension 339 forms a continuous continuation of the outside of the cylindrical part 335. The end part 338 is also mounted on the inner wall of the housing 313 of the fusing device 312. Provided in the extension 339 is an inlet opening 340 which tapers toward the bottom in a funnel-like fashion, and which merges into a feed channel 341 through which the weld material can be conveyed to the welding location. Essentially the entire length of the feed channel 341 is accommodated in the shoe body 342 of the welding shoe 322, which is mounted to the bottom of the end part 338. The welding shoe has a rectangular cross-section (FIG. 35), and extends to the longitudinal slot 305 of the inner connecting pipe 304. The feed channel 341 comprises a section disposed in the longitudinal axis 343 of the fusing device 312, and a conveying section which is connected at right angles thereto and extends to the outlet opening 344 of the welding shoe 322.

A welding rod 345 is used a the welding material, and comprises a synthetic material which is suitable for fusing. The welding rod is supplied from above through a guide tube 346 (FIG. 33). The guide tube 346 extends an appropriate distance toward the top, and is guided downwardly to the support 330 at a slight distance from the inner wall within the housing 313 of the fusing device 312. In so doing, the guide tube 346 passes through the end plate 318 and the frames 328, 323, 324, and extends to the support 330. The guide tube 346 is provided with an opening 347 which connects it with a bore 348 in the support body 333. The bore 348 ends in the annular space 349 which surrounds the granulating part 336 of the extruder screw 321.

To fuse the connecting pipes 303, 304 which are inserted in one another, the fusing device 312 is lowered in the inner connecting pipe 304 to the bottom end. When the fusing device is subsequently pulled up, the two connecting pipes 303, 304 are fused together. For this purpose, the welding rod 345 is pushed downwardly through the guide tube 346 to the granulating part 336 of the extruder screw 321. The granulating part 336 is embodied as a screw, and when the extruder screw is rotated, the thread of the granulating part 336 shears off in a granulating fashion that end of the welding rod which exits the bore 348 of the support body 333. As a result, as the welding rod enters the annular space 349, it is divided into individual granules. The thread of the granulating part 336 then conveys the sheared off granules into the cylindrical part 333, in which they are conveyed downwardly by the transport member 337 of the extruder screw 321 to the inlet opening 340. In order to bring the granules into that state necessary for fusing, air is supplied via the line 326, with this air being heated to the temperature required for fusing as it passes through the heating device 319. The air exits the heating device 319 in the region above an intermediate plate 350. So that the hot air in the region of the heating device 319 does not come into contact with the guide tube 346 for the welding rod 345, the housing 325 of the heating device 319 is surrounded by insulation 351 which extends in the region between the two frames 323 and 324, and is spaced from the housing 325. In the region between the frame 324 and the intermediate plate 350, the insulation 351 is extended in the vicinity of the guide tube 346, so that the hot air cannot reach the latter. Extending between the intermediate plate 350 and the support 330 is a hot air tube 352 through which the hot air which exits the heating device 319 can flow downwardly. The hot air tube 352 is disposed between the motor 320 and the inner wall of the housing 313 of the fusing device 312, and opens into an opening 353 in the support 330. The support body 333 is provided with a through bore 354 through which the hot air can flow further downward into an annular space 355 which is provided by the cylindrical part 335 and a sleeve 356 which surrounds and is spaced from the latter. The sleeve 356 is connected at the top to the bottom end of the support body 333, and rests on the end part 338. The hot air thus flows around the cylindrical part 335 and heats the granules of welding rod 345 transported by the transport member 337 to the melting temperature. Opening into the annular space 355 is a bore 357 in the shoe body 342 through which the hot air can exit the annular space 355 in the region just above the outlet opening 344 for the welding material. The opening 358 of the bore 357 is directed against the weld locations, which, as the welding device 312 is pulled up, are appropriately heated up just prior to the entry of the welding material. By means of a thermocouple 359, which projects into the bore 357 and is connected via an electrical line 360 with the control elements outside the fusing device, the temperature of the hot air leaving the welding shoe 322 can be monitored and controlled. The temperature of the hot air is such that the granules located in the cylindrical part 335 are melted as they are transported through the extruder screw 321, so that the melted material of the welding rod 345 passes via the inlet opening 340 into the bore 341, and exits the nozzle via the outlet opening 344. The latter is embodied in such a way that the melted synthetic material exits along the edges 308 and 309 of the longitudinal slot 305, and forms the weld seams 310 and 311. In this manner, when the fusing device 312 is pulled up, the weld seams 310 and 311 are continuously applied. During the time that the fusing device is being pulled up, the extruder screw 321 is continuously driven by the motor 320, and the welding rod 345 is continuously supplied via the guide tube 346. The air is similarly continuously supplied in the supply line 326. So that the welding rod 345 can be reliably pressed downwardly in the guide tube 346, its diameter is considerably less than the inner diameter of the guide tube. The insulation 351 in the vicinity of the heating device 319 reliably prevents the welding rod from already being heated in the region of the heating device, and from possibly sticking to the inner wall of the guide tube 346.

Cool air is supplied from the outside to the motor 320 to cool it. As shown merely schematically in FIG. 33, the cool air is supplied in a hose or tube 361, which is not illustrated in greater detail. The cool air reaches the motor at the upper end of the motor housing via a connection 362. The used air leaves the motor housing via an outlet connection 363 at the top of the motor housing, with this connection being connected via a line 364 with the guide tube 346 for the welding rod. The used air thus flows via the line 364 into the guide tube 346, in which it flows upwardly to thus additionally cool the welding rod 345, thus reliably preventing the welding rod from becoming caught on or sticking to the guide tube.

The insulation 351 is thick enough that the housing 313 of the fusing device 312 is not unduly heated in the vicinity of the heating device 319. As a result, the fusing device 312 can be pulled up without a problem during the fusing.

Figure 36:
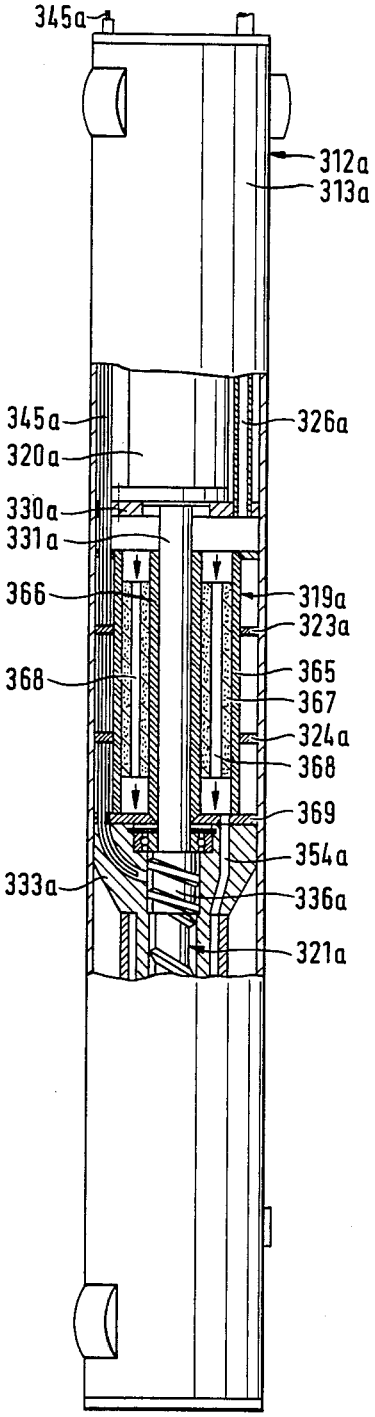
FIG. 36 is a partial elevational view and partial longitudinal section through a further embodiment of an inventive device.

FIG. 36 shows a fusing device **312*a* in which the heating device 319*a* is accommodated in the region between the motor 320*a* and the extruder screw 321*a*. The motor 320*a* is again seated on the support 330*a*. which is mounted on the inner wall of the housing 313*a* of the fusing device 312*a*. The drive shaft 331*a* of the motor 320*a* is considerably longer than it was in the previous embodiment. The drive shaft 331*a* passes through the heating device 319*a*, which has a cylindrical outer shell 365, the outer diameter of which is less than the inner diameter of the housing 313*a*, and which surrounds an inner shell 366 from which it is spaced. The inner diameter of the inner shell 366 is only slightly greater than the outer diameter of the drive shaft 331*a*. The space between the two shells 365 and 366 is filled with insulation 367, and is provided with a plurality of axially extending flow-through channels 368 for the air which is to be heated. Also accommodated in the insulation 367 are non-illustrated heating element which heat the air which flows through to the melting temperature of the welding rod 345*a* which is to be used for the fusing The heating element is again held in the housing 313*a* by the two frames 323*a* and 324*a*, which are disposed axially one above the other and at a distance from one another. The insulation 367 is axially shorter than the two shells 365 and 366, which have the same axial length. The upper ends of the shells are disposed at a distance below the support 330*a*, while the bottom ends of the shells rest upon an end plate 369 which is mounted on the support body 333*a***.

During the fusing process, the air which is to be heated is fed through the schematically indicated supply pipe or tube, and then passes through the support **330*a* into the flow-through channels 368, in which it is heated to the desired temperature as it flows through. As in the previous embodiment, the hot air then passes into the through bore 354*a* of the support body 333*a*. The heating device 319*a* is insulated to such an extent that the welding rod 345*a* is not heated in that region, so that there is also no danger that the welding rod will become caught in or stuck to the guide tube as it is being inserted. With the exception of the described differences, the fusing device 312*a* is constructed the same as the previous embodiment. Furthermore, the fusing device 312*a*** operates in the same manner as does the previously described embodiment.

Figure 37:
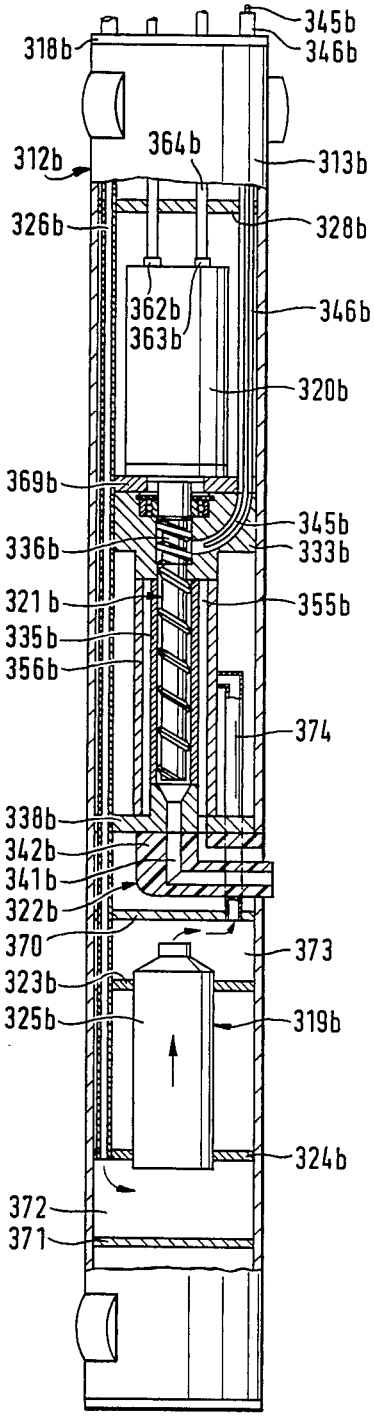
FIG. 37 is a partial plan view and partial longitudinal section through yet another embodiment of an inventive device.

In the embodiment of FIG. 37, the heating device **319*b* is disposed in the region below the welding shoe 322*b*. The air which is to be heated must therefore be supplied to the extruder screw 321*b* from below. In contrast to the embodiment of FIG. 33, the supply line 326*b* extends nearly adjacent to the inner wall of the housing 313*b* of the fusing device 312*b*, and passes through the end plate 318*b*, the frame 328*b* above the motor 320*b*, the end plate 369*b* upon which the motor sits, the support body 333*b*, the end part 338*b*, an end plate 370 disposed in the region below the welding shoe 322*b*, as well as the two frames 323*b*, 324*b* in which the housing 325b of the heating device 319b is held. Located at a distance below the heating device 319b and the lower frame 324b is a lower end plate 371, the periphery of which is mounted to the inner wall of the housing 313b. Together with the lower frame 324b and the corresponding surface of the housing 313b, the end plate 371 defines a collecting chamber 372 in which the air which is supplied through the line 326b empties. This air flows out of the collecting chamber 372 into the heating device 319b, as indicated by the arrows, and passes into an upper collecting chamber 373 which is defined by the upper frame 323b, the upper end plate 370, and the corresponding surface of the housing 313b. Opening into this collecting chamber 373 is a line 376 which connects the collecting chamber 373 with the annular space 355b between the cylindrical part 335b and the shell 356b. In this way, the air which is heated up in the heating device 319b to the required temperature passes into the annular space 355b, in which it can heat the granules of the welding rod 345b transported by the extruder screw 321b** to the melting temperature.

Since with this embodiment the heating device 319b and the supply location of the welding rod 345b to the extruder screw 321b are located quite far apart, and the hot air does not pass into the region of the welding rod, the latter does not have to be separately cooled. The welding rod is therefore merely pushed downwardly to the extruder screw through the guide tube 346b which extends in the region between the motor 320b and the inner wall of the housing 313b.

In other respects, the fusing device 313b operates as does the fusing device of FIG. 33. As the fusing device 312b is pulled up, the welding rod 345b is continuously sheared off into individual granules by the granulating part 336b of the continuously operating extruder screw 321b, which then conveys the granules downwardly. In the cylindrical part 335b, the welding rod granules are brought to the melting point by the hot air, and are pressed by the extruder screw into the bore 341b of the welding body 342b. The melted welding rod leaves the welding shoe 322b and passes into the region of the longitudinal edges 308 and 309 of the longitudinal slot 305 of the inner connecting pipe 304, thus producing a tight fused connection in the region of these longitudinal edges 308, 309 over the entire length of the connecting pipes 303, 304. The used air supplied for cooling the motor 320b enters via the connections 362b and leaves the motor via the outlets 363b. Since the welding rod 345b no longer has to be cooled, the lines connected to the outlets 363b extend axially upwardly parallel to the guide tube 346b. The shell 56b, which surrounds and is spaced from the cylindrical part 335b, is, as in the previous embodiments, sufficiently spaced from the surface of the housing 13b, so that the line 374 can be accommodated in the region between the shell and the surface of the housing.

The welding shoe 322, 322b is made of a material, preferably silicon, which can be easily shaped or worked. As a result, the welding shoe can be worked without difficulty in such a way that its shape can easily be conformed to the shape of the parts which are to be fused together. Silicon has the advantage of having a good sliding property, so that when the device is pulled up, the welding shoe 322, 322b can slide effortlessly along the parts 303, 304 which are to be fused.

Figure 38:
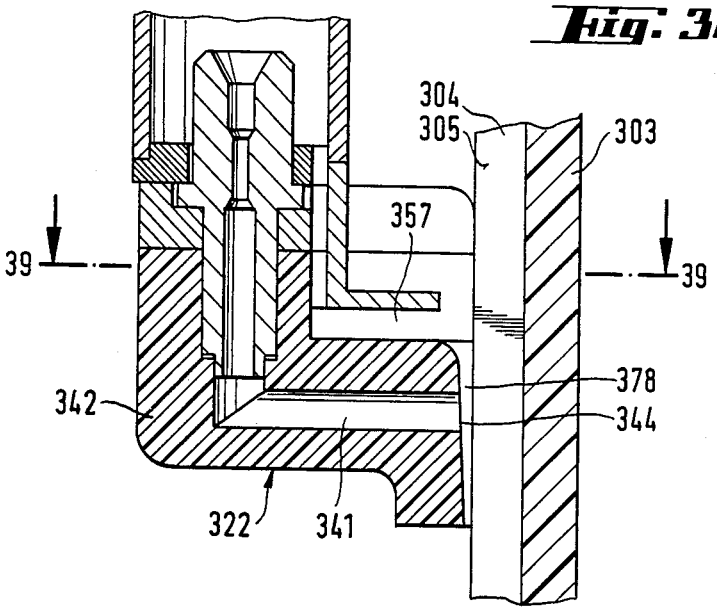
FIG. 38 is an enlarged sectional view of a welding shoe of the inventive device.
Figure 39:
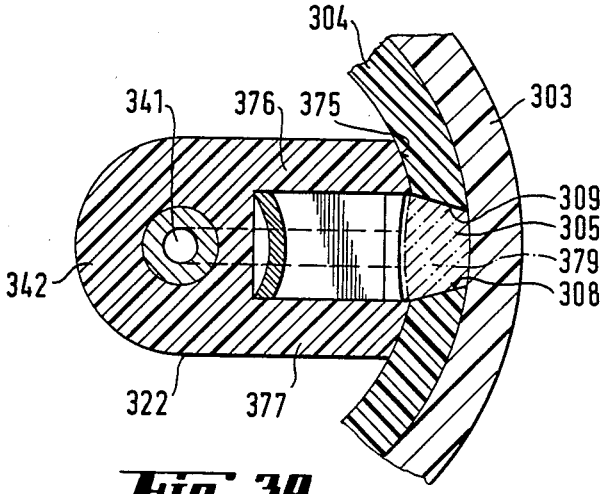
FIG. 39 is a view that shows a section taken along the line 39—39 in FIG. 38.

As shown in detail in FIGS. 38 and 39, the welding shoe 322 is embodied in such a way that its end face 375 rests completely against the inner connecting pipe 304. Since the welding shoe is made of material which can be easily worked, its end face 375 can at any time be made in such a way that it rests with its entire surface against the part which is to be fused. In the region above the hot-air passages 357, the welding shoe 322 is provided with two vertically disposed legs 376, 377 (FIG. 39) which extend parallel to one another, are disposed on the outsides of the welding shoe, and are intergral with the latter. The end faces of the legs 376,377 form a part of the end face 375 of the welding shoe Disposed in the end face 375 is a forming channel 378 which extends in the direction of movement of the device, and which is connected to the outlet opening 344 of the outlet passage 341. In the illustrated embodiment, the forming channel 378 extends upwardly and downwardly from the opening 344. The task of the forming channel 378 is to firmly press and give shape to the welding seam 379, the so-called weld bead, as it leaves the opening 344. Thus, as the device is pulled up, the welding seam 379 is shaped and firmly pressed immediately after the welding material leaves the opening 344, thus assuring a reliable fused connection. The forming channel 378 can taper toward the bottom, so that when the device is pulled up, the welding seam 379 is pressed and compressed to an increasingly greater extent.

The welding shoe 322 thus has several functions. First of all, it is used to apply the welding material, which is shaped by the forming channel 378, and is additionally pressed against and in thereby. Furthermore, hot air is blown out via the welding shoe 322.

The welding shoe 322b of the embodiment of FIG. 37 advantageously has the same construction.

The welding shoe 322, 322b does not necessarily have to be provided with the forming channel 378. Even without this channel a satisfactory fusing of the two connecting pipes 303, 304 to one another is achieved.

The present invention is, of course, in no way restricted to the specific disclosure of the specification and drawings, but also encompasses any modifications within the scope of the appended claims.

What we claim is:

1. An apparatus for joining together the slotted inner connecting pipe of a diaphragm section with the slotted outer connecting pipe of another diaphragm section in a slotted wall, with said inner connecting pipe being inserted in said outer connecting pipe; said apparatus comprising:

an extruder for extruding fusable material;

at least one guide means which extends to, and opens into, said extruder, and in which a welding rod can be moved to said extruder;

a granulating part connected to said extruder, in the vicinity of where said guide means opens into the latter, for shearing off said welding rod in a granulation manner;

a heating mechanism connected downstream of said granulating part, when viewed in the direction of movement of said welding rod, for melting the individual granules separated from the latter; and at least one welding shoe, which is connected to said extruder downstream of said granulating part, and has at least one outlet opening directed at the location which is to be fused.

2. An apparatus according to claim 1, which includes a heating device, and a line connected to a source of air.

3. An apparatus for joining together the slotted inner connecting pipe of a diaphragm section with the slotted outer connecting pipe of another diaphragm section in a slotted wall, with said inner connecting pipe being inserted in said outer connecting pipe; said apparatus comprising:

an extruder for extruding fusable material;

at least one guide means which extends to, and opens into, said extruder, and in which a welding rod can be moved to said extuder;

a size-reducing part connected to said extruder, in the vicinity of where said guide means opens into the latter, for reducing the size of said welding rod;

a heating mechanism connected downstream of said size-reducing part, when viewed in the direction of movement of said welding rod, for melting the size-reduced pieces of the latter;

at least one welding shoe, which is connected to said extruder and has at least one outlet opening directed at the location which is to be fused;

a heating device, and a line connected to a source of air; and housing means for said heating device, which is disposed above said extruder; and insulation disposed in said housing means completely around said heating device, at least in the region of said guide means.

4. An apparatus according to claim 3, in which said welding shoe has a hot air channel which is connected to said heating mechanism, and which opens out directly above said outlet opening.

5. An apparatus according to claim 4, which includes a thermocouple disposed in said hot air channel.

6. An apparatus according to claim 4, in which said welding shoe has an end face facing said inner connecting pipe, with a forming channel being provided in said end face; said forming channel extending in the direction of movement of said apparatus, and communicating with the bottom side of said outlet opening.

7. An apparatus for joining together the slotted inner connecting pipe of a diaphragm section with the slotted outer connecting pipe of another diaphragm section in a slotted wall, with said inner connecting pipe being inserted in said outer connecting pipe; said apparatus comprising:

an extruder for extruding fusable material;

at least one guide means which extends to, and opens into, said extruder, and in which a welding rod can be moved to said extruder;

a size-reducing part connected to said extruder, in the vicinity of where said guide means opens into the latter, for reducing the size of said welding rod;

a heating mechanism connected downstream of said size reducing part, when viewed in the direction of movement of said welding rod, for melting the size-reduced pieces of the latter; and at least one welding shoe, which is connected to said extruder and has at least one outlet directed at the location which is to be fused; a heating device, and a line connected to a source of air; said size-reducing part being a first screw, and said extruder being a transport member which is in the form of a second screw and is surrounded by said heating mechanism.

8. An apparatus according to claim 7, in which said air supply lines passes through said heating device; in which said heating mechanism includes a heating channel; and which includes passage means for connecting said heating channel with said air supply line.

9. An apparatus for joining together the slotted inner connecting pipe of a diaphragm section with the slotted outer connecting pipe of another diaphragm section in a slotted wall, with said inner connecting pipe being inserted in said outer connecting pipe; said apparatus comprising:

an extruder for extruding fusable material;

at least one guide means which extends to, and opens into, said extruder, and in which a welding rod can be moved to said extruder;

a size-reducing part connected to said extruder, in the vicinity of where said guide means opens into the latter, for reducing the size of said welding rod;

a heating mechanism connected downstream of said size-reducing part, when viewed in the direction of movement of said welding rod, for melting the size-reduced pieces of the latter; and at least one welding shoe, which is connected to said extruder and has at least one outlet opening directed at the location which is to be fused; a heating device, and an air supply line connected to a source of air; said heating device being disposed below said extruder; a first collecting chamber disposed below said heating device and in communication with said air supply line; and a second collecting chamber which is disposed above said heating device, communicates with said first collecting chamber, and communicates with said heating mechanism to supply hot air thereto.

10. An apparatus for joining together the slotted inner connecting pipe of a diaphragm section with the slotted outer connecting pipe of another diaphragm section in a slotted wall, with said inner connecting pipe being inserted in said outer connecting pipe; said apparatus comprising:

an extruder for extruding fusable material;

at least one guide means which extends to, and opens into, said extruder, and in which a welding rod can be moved to said extruder;

a size-reducing part connected to said extruder, in the vicinity of where said guide means opens into the latter, for reducing the size of said welding rod;

a heating mechanism connected downstream of said size-reducing reducing part, when viewed in the direction of movement of said welding rod, for melting the size-reduced pieces of the latter; and at least one welding shoe, which is connected to said extruder and has at least one outlet opening directed at the location which is to be fused; a heating device, and an air supply line connected to a source of air; and a motor for said extruder and said size-reducing part; which includes a cool air supply connected to said motor; and which includes a used-air line which is connected to said motor and to said guide means for said welding rod.

11. An apparatus according to claim 10, which includes housing means for said heating device, said motor, said extruder, and said heating mechanism.

* * * * *